US006145176A

United States Patent [19]

Egnaczak et al.

[11] Patent Number: 6,145,176

[45] Date of Patent: Nov. 14, 2000

[54] APPARATUS FOR REPLACEMENT AND ALIGNMENT OF NEEDLE BOARDS IN A NEEDLE LOOM

[75] Inventors: Kenneth A. Egnaczak, Cheshire; Edward C. Kirchner; Robert P. Langdon, both of Pittsfield, all of Mass.

[73] Assignee: Morrison Berkshire, Inc., North Adams, Mass.

[21] Appl. No.: 09/322,634

[22] Filed: May 28, 1999

[51] Int. Cl.[7] ..... D04H 18/00

[52] U.S. Cl. ..... 28/107; 28/115

[58] Field of Search ..... 28/107, 109, 110, 28/113, 114, 115; 414/331, 788, 788.1, 788.2, 790.1, 790.4, 790.2, 288

[56] References Cited

U.S. PATENT DOCUMENTS

| | | | |
|---|---|---|---|
| 3,605,223 | 9/1971 | Barth | 28/115 |
| 3,889,326 | 6/1975 | Tyas | 28/115 |
| 4,777,706 | 10/1988 | Stanislaw | 28/110 |
| 4,878,799 | 11/1989 | Seto et al. | 414/331 |
| 4,884,324 | 12/1989 | Stanislaw | 28/107 |
| 4,926,530 | 5/1990 | Stanislaw | 28/111 |
| 5,117,541 | 6/1992 | Leuchtenmuller | 28/115 |
| 5,287,604 | 2/1994 | Feyerl | 28/115 |
| 6,003,215 | 9/1999 | St. Jacques | 28/107 |

FOREIGN PATENT DOCUMENTS

| | | | |
|---|---|---|---|
| 1134637 | 1/1985 | U.S.S.R. | 28/115 |

*Primary Examiner*—Amy B. Vanatta

*Attorney, Agent, or Firm*—Lerner, David, Littenberg, Krumholz & Mentlik, LLP

[57] ABSTRACT

A system is disclosed for attaching in a needling apparatus, such as a needle loom, tacker and the like, a plurality of needle boards to a plurality of needle beams in alignment therewith. A plurality of needle boards having upwardly extending attachment members are supported on a plurality of needle board carts which are movable into the needling apparatus to a position underling one of the needle beams for attachment thereto. The carts are supported by the stripper plate as they move through the needle zone. Each of the carts includes a locator member for alignment of the needle board therewith when supported on the cart. The carts and support needle boards are raised for engagement with the needle beam by operation of the stripper plate. The needle beams include a support plate having a plurality of openings for receiving therethrough the attachment members of a corresponding needle board, thereby aligning the needle board at a predetermined position to the needle beam. A clamp plate assembly overlying the support plate is movable between a first position for engaging the attachment members extending through the openings and a second position for releasing the attachment members. An actuating device positioned between the clamp plate and a portion of the needle beam is operative for drawing the needle boards against the support plate for attachment thereto in predetermined alignment.

111 Claims, 11 Drawing Sheets

APPARATUS FOR REPLACEMENT AND ALIGNMENT OF NEEDLE BOARDS IN A NEEDLE LOOM

FIELD OF THE INVENTION

The present invention generally relates to needle looms having at least one zone containing a plurality of needle boards utilized for the manufacture of needled fabric webs, and more particularly, to an apparatus and method which simplifies the installation, replacement and alignment of needle boards as a result of worn or damaged needles with a minimum amount of operator involvement and needle loom down time.

BACKGROUND OF THE INVENTION

Manufacturing of papermakers' fabrics, for example, traditionally include a number of different types of machines and equipment. For instance, manufacturing plants generally include a weaving loom for weaving of the base fabrics which, for example, may comprise woven monofilament mesh fabrics, a finishing machine onto which the base fabric produced on the weaving loom is placed for heat treating or setting of the woven base fabric in order, for example, to fix the size of the fabric, and a needle loom for needling fibrous material to the base fabric to fully integrate and unite the fibrous material into and amongst the base fabric and themselves.

In addition, these plants also generally include a batt-making line for producing a carded fiber web or batt of narrow width, and a cross lapping apparatus for producing a cross-layered fibrous web of a width corresponding to the width of the base fabric. The cross-layered fibrous web may be applied directly from the cross lapping apparatus to the base fabric, or may first be tacked together, rolled onto a separate roll and then later unwound for being applied to the base fabric. The batt-making line may, in turn, include equipment for opening of textile fibers, equipment for blending of the fibers, and equipment for carding or orienting of the fibers to produce the carded fiber web or batt.

Needle looms are complicated, sophisticated pieces of equipment which generally have a plurality of separate needling stations or zones, each of which generally includes a plurality of juxtaposed needle boards mounted to a reciprocating mechanism mounted to a machine frame so as to extend across the working width of the loom. The needle boards each include a multiplicity of needles arranged in rows and columns, or randomly arranged, which are moved up and down to pierce the fiber layer applied to the base fabric in order to lock the fibers to the base fabric. Generally, several passes are made past the needling stations in order to fully and properly needle the fibrous layer to the base fabric. Further, when needling cross-layed fibrous webs to the base fabric, the full-width needle boards are initially operated so as to tack the cross-layed web in place in order to initially hold the layed fibrous material in place. The tacking operation is generally accomplished at a slow stroke rate, but at a high fabric advance rate per loom stroke.

After the fibrous material has been tacked in place, the needle boards are then operated utilizing the needles at full penetration to fully lock and unite the fibrous material to the base fabric. This is accomplished at a faster speed than that at which the fibers are initially tacked in place, and thus, the needle loom has a greater throughput. After complete and full needling, the endless fabric web having the fiber layer needled thereon is taken off and may be placed on a finishing machine for heat-setting of the finished felts and/or for other surface treatments, such as compaction, washing and/or vacuuming.

In terms of the operational process in the manufacture of endless papermakers' felts, the piece of equipment generally having the most downtime, and also, the most expensive piece of equipment, is generally the needle loom. In terms of the speed of operation, in present day plants, only one finishing machine is required for every two to three needle looms. That is, one finishing machine in a plant can supply finished, heat set base fabrics for two to three needle looms operating at conventional speeds and/or can finish or surface condition produced felts from two to three needling looms. Simply put, conventional needling looms are among the most expensive pieces of machinery in a papermakers' felt production plant, and also, among the slowest operating by virtue of having a substantial amount of downtime. Downtime results from a number of factors, for example, set up time for the fabric and needle boards, needle board repair and replacement, etc. As a result, the run or operating time of the needling loom is often small compared to the downtime. For example, it has been determined that in certain applications the needle loom downtime has resulted in loom utilization of only about fifteen percent of the total number of hours available. Consequently, it is most important in order to efficiently and economically produce endless needled fabric to minimize needling loom downtime and to maintain the needling looms operating at full capacity and performing their intended needling functions at all times, i.e., increasing overall availability of the needling loom.

During operation of the needle loom, the needles of the needle board are subjected to natural wear, as well as a more or less large amount of needle breakage. As a consequence, an increasingly larger number of needles are no longer available for the needling process. Needles which fail during operation of the needle loom increasingly deteriorate the quality of the produced needled fabric. Damage to the needles reduces the usability of the needle board earlier than the time set at which, due to general wear, all needles would be replaced or a replacement of the entire needle board and the attached needles. In addition, it is known to periodically replace a percentage of the needles, typically the oldest needles, even though they are not broken. For example, maintenance of the needle boards might include replacement of one or more rows of needles every three to four days of needle loom operation. Accordingly, a needle board at any one time will contain needles of varying age and wear.

The needle boards are arranged in the needle loom in one or more zones overlying and/or underlying the endless fabric web to be needled. A typical needle loom, such as a duplex loom in which needling of the endless fabric web occurs concurrently from both above and below the web being processed, may include four zones of needle boards. Each zone may include, for example, eight to ten needle boards (each needle board having seventeen rows of needles) which ultimately require replacement when the needles become worn and/or damaged during operation of the needle loom.

The needle boards have previously been replaced by manual operation. In this regard, an operator after stopping operation of the needle loom, would withdraw a needle board from a needle board zone one board at a time. The withdrawn needle boards would be manually transported from the needle loom to a storage cart. Once all of the needle boards for a given zone were removed, the replacement needle boards would be inserted into the needle loom, one needle board at a time. This replacement process would require that an operator be constantly manually transporting worn or damaged needle boards withdrawn from the needle loom and replacement needle boards back and forth between one or more designated storage carts. Due to the large number of needle boards, the replacement process could take anywhere from six to eight hours per needle loom zone. As previously noted, it is most important in order to efficiently and economically produce endless needled fabric webs that the needle looms be operating continuously at full capacity at all times. Thus, the extended down time of the needle loom for needle board replacement has been recognized as a serious drawback in the efficient and economical production of needled fabric webs.

To this end, there is known from copending U.S. application Ser. No. 09/204,023, filed on Dec. 1, 1999 entitled "Apparatus For Replacement of Needle Boards in a Needle Loom", an apparatus for the installation, removal, storage and transport of needle boards during replacement in a needle loom. The disclosure of the aforementioned '023 Application, which is assigned to the same assignee of the present application, is incorporated herein by reference. The apparatus includes a two stage magazine designed to accommodate two full compliments of needle boards for any needle zone in a given needle loom. One stage of the magazine provides independent storage for spent needle boards as they are removed from the needle loom, while the other stage contains replacement needle boards that will later be loaded into the loom. A linear slide assembly allows the entire magazine to be moved from a first stage position for unloading spent needle boards to a second stage position for loading replacement needle boards with minimal physical effort. Needle board receiver openings on the magazine in registration with each stage are positioned at the exact height of the needle zones of the needle loom so the operator can roll the needle boards directly to or from the loom into the magazine with minimal or no handling in-between. A manually or motor operated mechanism allows the operator to index needle board positions inside each stage of the magazine providing vacancies for spent needle boards as they are removed from the loom (or exposing replacement boards for loading into the loom). The apparatus may be mounted on heavy duty casters or wheels for easy transport of needle boards to and from the needle loom and may have precision locating pins to rapidly and accurately position the apparatus in front of the needle loom during needle board replacement.

The apparatus of the '023 Application may be integrated into a system to expedite the process of needle board removal by integrating the operation of various system components relating to the needle board, e.g., needle board clamp, needle board locators, needle board removal wheels and needle board connecting links. The needle board clamp is a fully automatic pneumatic clamp that is used to fasten the needle boards in the needle loom. A single solenoid valve energizes (or de-energizes) the clamp that locks all the needle boards into one or more needle board modules. The clamping operation may also be effected manually. The needle board locators are precision machined locating pins used to accurately align the needle boards in the needle board modules before they are clamped in place. These locators eliminate the time previously required by the needle loom operator to manually align the boards prior to clamping them in place. Each needle board is equipped with removal wheels that allow the loom operator to roll the board in or out of the needle loom with minimal physical effort. Guides or tracks for the wheels allow the boards to be rolled the entire width of the needle loom for removal at the "open end" of the loom. Individual needle boards are interconnected by the needle board connecting links which allow the loom operator to extract all the boards from a fixed position at the "open end" of the needle loom. The links also serve to accurately maintain the needle board to needle board positioning when installed in the needle loom.

SUMMARY OF THE INVENTION

The present invention provides an apparatus and method which enables the installation, removal and replacement of needle boards in alignment within a needle loom, and specifically the needle beam, with a minimum amount of needle loom down time and operator intervention so as to maintain the efficient and economical operation thereof in the production of endless needled fabric webs. Accordingly, the apparatus and method of the present invention expedites the installation and removal of needle boards from needle looms thereby increasing overall loom performance. Because the present invention requires less operator intervention than heretofore known, an increased margin of operator safety may be achieved. The present invention may be integrated into the design of new needle looms, as well as a retrofit design for existing looms.

In accordance with one aspect of the present invention, needle boards which contain attachment members in the nature of fasteners which mate with the needle loom driving mechanism, i.e., the needle beam, are positioned in predetermined alignment on wheeled needle board carts, one needle board per cart. The loaded needle board carts are releasably linked together as they are fed into the needling zone of the needle loom. The individual carts are contained within the structure of the needle loom stripper plates by the needle board carts being supported by bottom wheels and sidewalls having outwardly extending sidewheels. When a full complement of loaded needle board carts are delivered and positioned against a locating feature, such as a portion of the stripper plate, the stripper drive mechanism, e.g., screw jacks, carries the loaded needle board carts to engage their respective needle beams.

Once engaged and temporarily clamped by the stripper driver mechanism, the needle boards having been positioned and aligned by a feature of their attachment members, are secured to their respective needle beams by a clamping mechanism attached to the needle beams. The mechanism is in the nature of a clamp plate which engages the needle board attachment members and clamps the needle boards to the needle beam with a pneumatic actuator, for example, an air inflatable bladder. A fail-safe device within the needle beam retains the needle boards in securement to the needle beam in the event of failure of the clamp plate actuator or bladder. Upon clamp-up of the needle boards to their respective needle beams, the now unloaded carts disengage from the needle boards as the stripper plate lowers away from the needle beams. When the stripper plate reaches the load/unload position, the empty carts are rolled out of the needling zone, detached, and stored. The needle loom having the needle boards installed is ready to perform the needling operation.

The apparatus and method of the present invention provide the needle loom with numerous advantages and features, for example, the loom stripper plate functions as the load/unload delivery member; the needle loom stripper plate approximately positions the needle boards in the machine direction; the wheeled needle board carts transport the needle boards in and out of needling zone; the clamping mechanism is a "quick clamp" device in the nature of a snatch and clamp assembly having two sequential motions; approximate cross machine positioning is accomplished by aligning needle beam and needle board side pins by a fork located on the needle board cart; the temporary needle board clamping force from the needle loom stripper plate is delivered through the carts without loading the cart frame; the inflatable clamping bladder is inside the needle beam; the needle board carts are detachable link joined; the clamp load is a constant force to account for wear and geometric irregularities not based on the tolerance of the clamp members; the system can be configured to allow single or multiple needle board change-out; the system employs a mechanical fail-safe feature in the nature of a spring assembly that captures the needle board to the needle beam if the clamp bar actuator or air bladder fail; the needle beam structure and needle board fastener placement are designed to minimize loaded deflection and component weight; the needle board carts provide protection to the needles of the needle board during transport; the system offers variable/multiple speed screw jacks which speed up the installing of the needle boards; the needle board carts contain resilient structures to evenly distribute the temporary clamp load and the needle board cart sidewheels can be spring loaded to accommodate track irregularities; the needle board carts are designed to be light in weight for ease of picking up the needle board and cart at the same time by the operator; the needle beams employ cast-in polymer surfaces as guide bushings to interface with the needle board fastener positioning feature to minimize wear; needle board fasteners are both locators and structures to deliver the clamp force pins for both registration and fastening; the needle beam is an open structure being stiffened with a bolted on structural cover; and the system is suitable as OEM or retrofit.

In accordance with one embodiment of the present invention there is described a cart for supporting a needle board for installation and removal in a needling apparatus, the cart comprising a frame supportable for movement within the needling apparatus, a locator member attached to the frame, the locator member releasably engaging a portion of the needle board for aligning the needle board with the frame when supported thereon.

In accordance with another embodiment of the present invention there is described a cart supporting a needle board for installation in a needling apparatus, the cart comprising a frame having spaced apart sidewalls, a plurality of wheel assemblies attached to the sidewalls, each of the wheel assemblies having a first axle rotationally supporting a wheel and a second axle rotationally supporting another wheel, the first and second axles arranged transverse to each other, a plate extending upwardly from the frame, having an elongated opening communicating with an enlarged opening, and a needle board supported on the wheel assemblies, the needle board having at least one pin received within the elongated opening as the pin passes through the enlarged opening when positioning the needle board on the frame.

In accordance with another embodiment of the present invention there is described a needle beam for releasably securing a needle board thereto in a needling apparatus, the needle beam comprising a support plate for engaging a needle board, the needle board having a plurality of attachment members extending therefrom, the support plate having a plurality of openings for receiving the attachment members thereby aligning the needle board at a predetermined position to the needle beam, a clamp plate overlying the support plate moveable between a first position for engaging the attachment members extending through the support plate and a second position for releasing the attachment members, and an actuating device arranged between the clamp plate and the support plate, whereby actuation of the device draws the needle board against the support plate for securement thereto in alignment with the needle beam.

In accordance with another embodiment of the present invention there is described a needling apparatus having a needle beam for releasable securing thereto a needle board, wherein the improvement comprises the needle board including a plurality of spaced apart attachment members extending upwardly therefrom, each of the attachment members having an engagement portion, and the needle beam comprising a support plate having a plurality of openings for respectively receiving one of the attachment members thereby aligning the needle board with the needle beam at a predetermined position, a clamp plate overlying the support plate moveable between a first position for engaging the engagement portions of the attachment members when extending through the openings in the support plate and a second position for disengaging from the engagement portions of the attachment members to allow withdrawal of the attachment members from the openings to allow removal of the needle board, and an inflatable bladder arranged between the clamp plate and the support plate of the needle beam opposing the needle board, whereby expansion of the bladder draws the needle board against the support plate for securement thereto in alignment with the needle beam.

In accordance with another embodiment of the present invention there is described a system for attaching in a needle zone a plurality of needle boards to a plurality of needle beams in alignment therewith, the system comprising a plurality of needle boards each having a plurality of attachment members extending therefrom; a plurality of needle board carts each supporting one of the needle boards thereon, the needle board carts moveable within the needling apparatus to a position underlying one of the needle beams for attachment thereto of one of the needle boards supported by the cart, each of the carts including a locator member for alignment of the needle boards therewith when supported on the cart; and the needle beams each including a support plate having a plurality of openings for receiving therethrough the attachment members of a corresponding needle board thereby aligning the needle board at a predetermined position to the needle beam, a clamp plate overlying the support plate moveable between a first position for engaging the attachment members extending through the openings and a second position for releasing the attachment members, an actuating mechanism controlling the movement of the clamp plate between the first and second positions, and an actuating device between the clamp plate and a portion of the needle beam opposing the needle board, whereby actuation of the device draws the needle board against the support plate for attachment thereto in predetermined alignment therewith.

In accordance with another embodiment of the present invention there is described a method for replacing a plurality of needle boards in a needle zone including a plurality of needle beams each having a support plate provided with a plurality of openings and a clamp plate assembly associated therewith, the method comprising providing a plurality of needle boards having a plurality of attachment members extending therefrom, supporting the needle boards on a corresponding needle board cart, advancing a plurality of the needle board carts with the needle boards supported thereon in end to end relationship into the needle zone underlying the needle beams, passing the attachment members through the openings in the support plate of the needle beam, activating the clamp plate assembly to engage the attachment members extending through the support plate on an underlying needle board, and securing the needle boards to the needle beams.

In accordance with another embodiment of the present invention there is described a method for replacing a needle board in a needle zone including a needle beam having a support plate provided with a plurality of openings, the method comprising providing a needle board having a plurality of attachment members and a pin extending therefrom, providing a needle board cart having an opening, supporting the needle board on the cart with the pin received within the opening, positioning the needle board supported by the cart underlying the needle beam, passing the attachment members through the openings in the support plate of the needle beam, engaging the attachment members extending through the support plate for supporting the needle board by the needle beam independent of the cart, and securing the needle board to the needle beam.

In accordance with another embodiment of the present invention there is described a method for replacing a plurality of needle boards in a needle zone including a plurality of needle beams each having a support plate and a clamp plate assembly associated therewith having a plurality of attachment members extending therefrom, the method comprising providing a plurality of needle boards having a plurality of openings, supporting the needle boards on a corresponding needle board cart, advancing a plurality of the needle board carts with the needle boards supported thereon in end to end relationship into the needle zone underlying the needle beams, passing the attachment members through the openings in the needle boards, activating the clamp plate assembly to engage the attachment members extending through the openings on an underlying needle board, and securing the needle boards to the needle beams.

In accordance with another embodiment of the present invention there is described a needle beam for releasably securing a needle board thereto in a needling apparatus, the needle beam comprising a support plate for engaging a needle board, a clamp plate overlying the support plate having a plurality of attachment members extending therefrom, the needle board having a plurality of openings for receiving the attachment members thereby aligning the needle board at a predetermined position to the needle beam, the clamp plate moveable between a first position for engaging the attachment members extending through the needle board and a second position for releasing the attachment members, and an actuating device arranged between the clamp plate and the support plate, whereby actuation of the device draws the needle board against the support plate for securement thereto in alignment with the needle beam.

BRIEF DESCRIPTION OF THE DRAWINGS

The above description, as well as further objects, features and advantages of the present invention will be more fully understood with reference to the following detailed description of an apparatus for replacement and alignment of needle boards in a needle loom, when taken in conjunction with the accompanying drawings, wherein.

DETAILED DESCRIPTION OF THE PREFERRED EMBODIMENTS

In describing the preferred embodiments of the subject matter illustrated and to be described with respect to the drawings, specific terminology will be resorted to for the sake of clarity. However, the invention is not intended to be limited to the specific terms so selected, and is to be understood that each specific term includes all technical equivalence which operate in a similar manner to accomplish a similar purpose.

Figure 1:
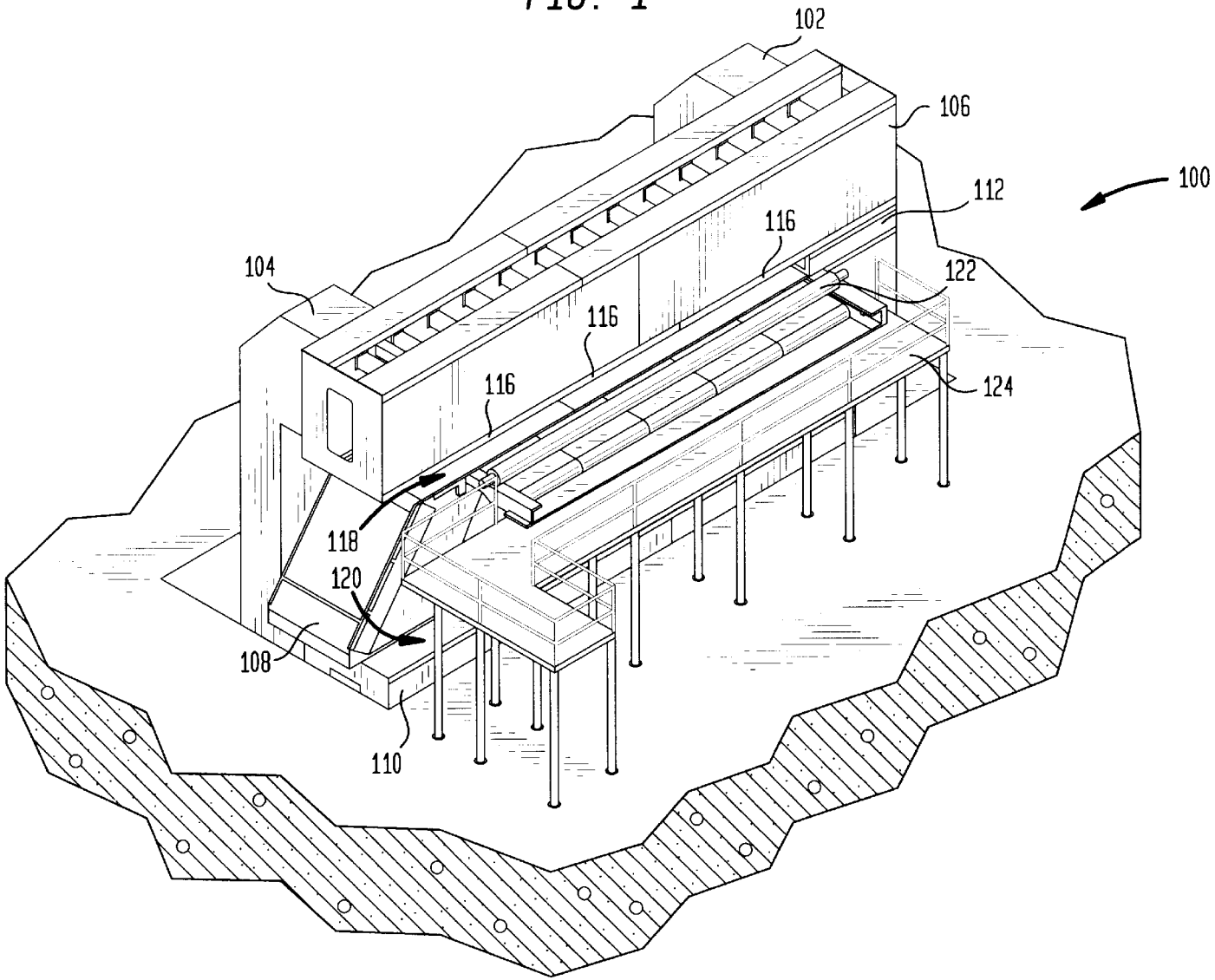
FIG. 1 is a perspective view diagrammatically illustrating a needle loom for manufacture of endless needled fabric webs incorporating a plurality of needle boards.
Figure 2:
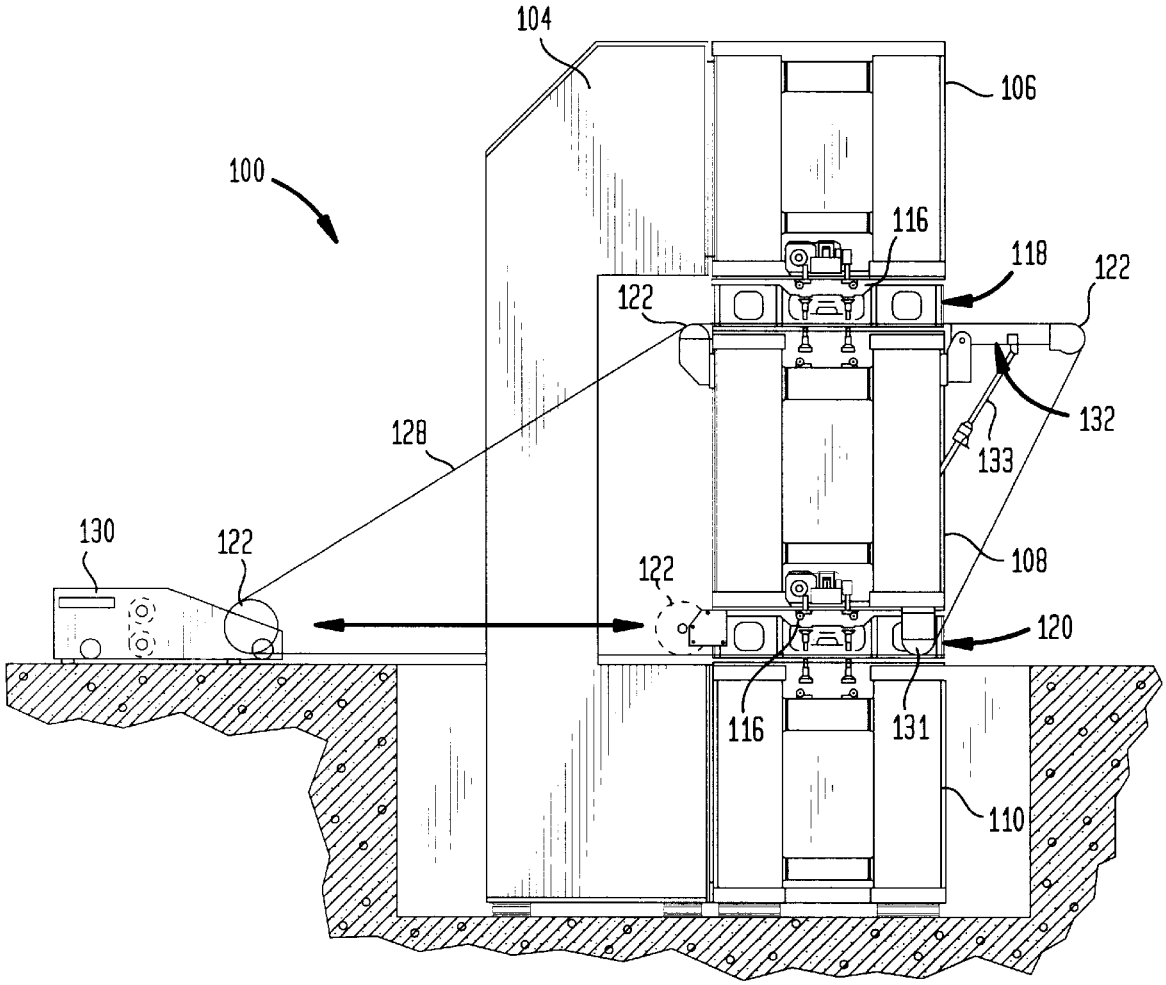
FIG. 2 is a side elevational view of the needle loom generally illustrated in FIG. 1 showing a duplex construction having upper and lower needle board zones.
Figure 3:
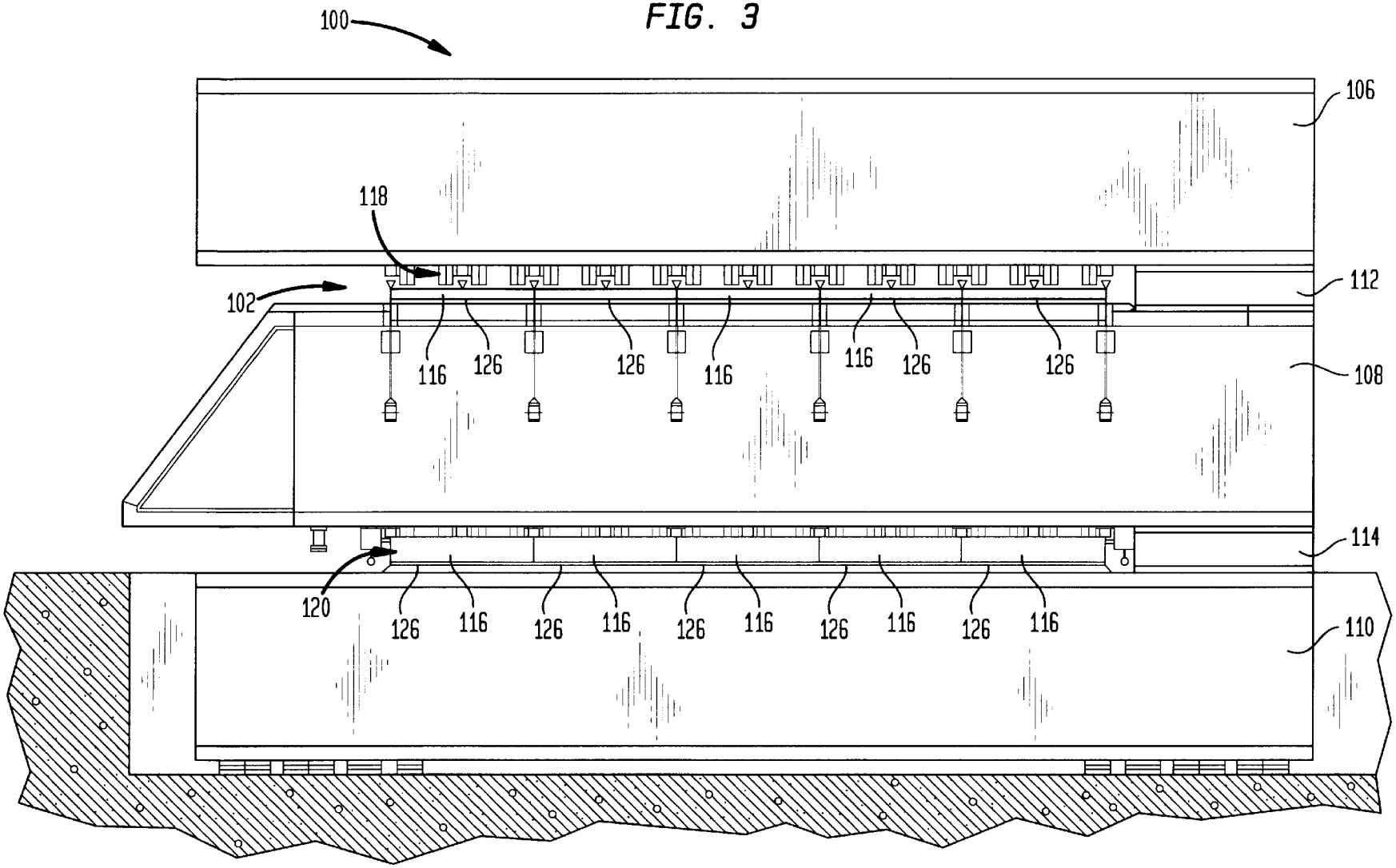
FIG. 3 is a front elevational view of the needle loom as illustrated in FIG. 2.

Turning now to the drawings, wherein like reference numerals represent like elements, there is shown in FIGS. 1–3 a needle loom generally designated by reference numeral 100. The needle loom 100 illustrated, by way of example, is a high speed needle loom having two zones such as available from Morrison Berkshire, Inc. of North Adams, Mass. The construction of a needle loom 100, of the aforementioned type, is generally described in U.S. Pat. Nos. 4,926,530, 4,884,324 and 4,777,706, all assigned to Morrison Berkshire, Inc., the disclosures of which are incorporated herein by reference.

Generally, a needle loom 100 of the aforementioned type includes a pair of spaced apart open end frames 102, 104, a top spar 106, a bottom beam 108, a base beam 110, intermediate supports 112, 114, a plurality of needle beam modules 116 arranged in upper and lower needle board zones 118, 120, a plurality of endless fabric web supporting rollers 122 and a utility catwalk 124. The main areas of the needle loom 100 to which the present invention is directed are the upper and lower needle board zones 118, 120. As is conventional, the needle loom 100 includes a plurality of needle beam modules 116 which are operatively interconnected, being supported by the top spar 106 and bottom beam 108 in one or more rows extending transversely across the entire width of the needle loom. Each of the needle beam modules 116 will support one or more needle boards 126, see FIG. 3, each of which includes a plurality of needles.

Figure 4:
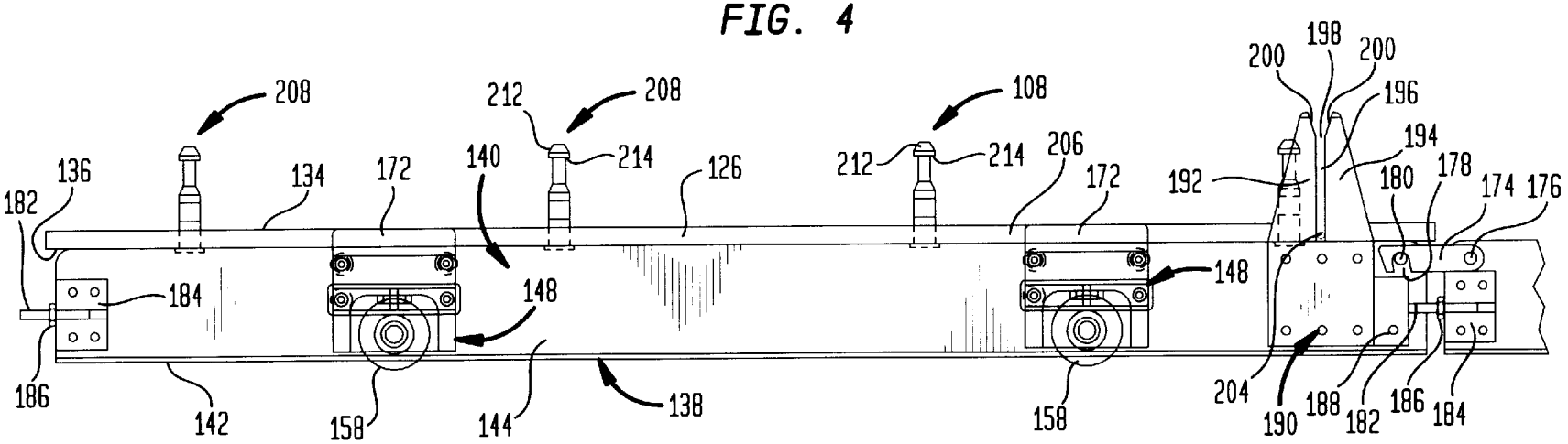
FIG. 4 is a side elevational view of a needle board cart in accordance with one embodiment of the present invention supporting a needle board having a plurality of attachment members.

There is illustrated in FIG. 4 a needle board 126 which has a rectangular shape including side edges delineating a top surface 134 and a bottom surface 136. It is to be understood that the needle board 126 can be constructed in a multitude of geometries, materials and configurations. In accordance with the present invention, the needle board 126 is provided with certain construction features which, as to be described hereinafter, provide the needle board with certain attributes which facilitate its use and alignment in a needle loom.

An endless fabric web 128, see FIG. 2, to be needled is threaded into or loaded onto the needle loom 100 so as to follow an endless path defined by the rollers 122. The endless fabric web 128 coextensively extends within the upper and lower needle board zones 118, 120 so as to be in operative association with the plurality of needle beam modules 116. A loom tensioning assembly 130 is operative for movement of its end supported roll 122 as shown in the far left portion of FIG. 2 towards and away from the bottom beam 108 for loading and unloading the endless fabric web 128 into the needle loom 100, as well as tensioning the web during the needling operation. One of the rollers 131 as shown in the far right portion of FIG. 2 is driven by a motor control assembly (not shown) in order to drive the endless fabric web 128 through its endless continuous path through the upper and lower needle board zones 118, 120. Platform assembly 132 can be raised and lowered to facilitate inserting and removing of the web 128 within the needle loom 100 by means of an extendable hydraulic assembly 133.

The needle loom 100 is operated in a conventional manner to fully and completely needle the endless fabric web 128 in order to fully incorporate and lock the fibrous material which has been supplied thereto. This operation continues until the entire length of the endless fabric web 128 has the fibrous material fully needled thereto along its entire length. Depending upon the speed of operation of the needling operation, the number of needles used, and the amount of needling required to fully lock the fibrous material to the underlying endless fabric web 128, a number of passes past the needle beam modules 116 may be required. After completion of full-width needling of the fibrous material to the endless fabric web 128, the web is removed from the needle loom 100 and then subjected to further operations, as is conventional. Such further operation may include the needling of additional layers of fibrous material to the endless fabric web 128 and/or surface conditioning and/or other heat treating operations with respect to the needled web. These additional operations generally are accomplished on other machines (not shown). A further description of the operation of a needle loom 100, such as the needle loom illustrated in FIGS. 1–3, is disclosed in the aforementioned United States patents, which operation is incorporated herein by reference.

Referring to FIGS. 4–7, there will now be described a needle board wagon or cart generally designated by reference numeral 138. The cart 138 is generally constructed from a U-shaped frame 140 composed of a bottom wall 142 and spaced apart upstanding sidewalls 144, 146. A plurality of wheel assemblies 148 are supported in spaced apart relationship on each of the sidewalls 144, 146. The wheel assemblies are shown in detail in FIG. 7 by way of one embodiment. The wheel assemblies 148 are operative to allow movement of the cart 138 within the needle loom 100, specifically along the stripper plates, and to provide lateral positioning as to be described hereinafter. The wheel assemblies 148 may be replaced, if desired, by a slide assembly or device having, for example, bottom and side rails which allow the needle board cart 138 to be slid into and out of the stripper plate in a similar manner as accommodated by the wheel assemblies.

Figure 7:
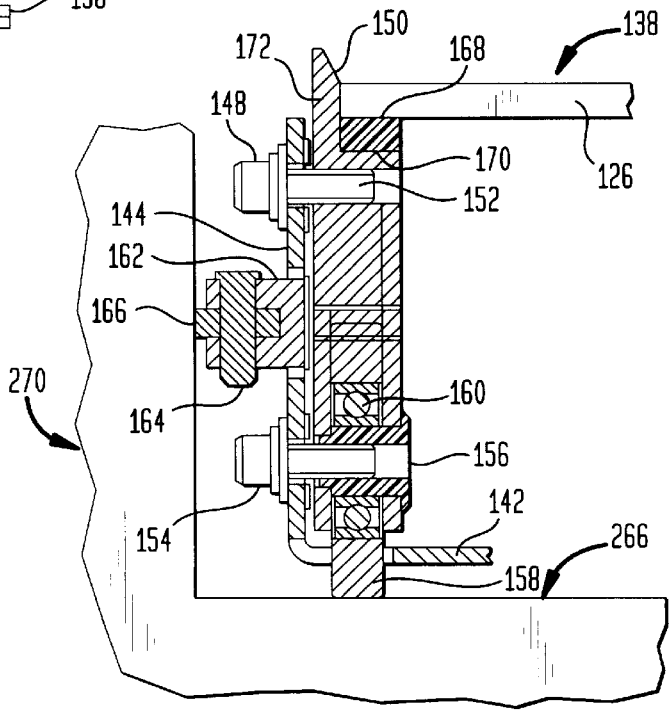
FIG. 7 is a cross-sectional view of a wheel assembly for the needle board cart taken along line 7—7 in FIG. 5.

Referring to FIG. 7, the wheel assemblies 148 each include a wheel housing 150 which is secured to the interior surface of the sidewall 144, as well as sidewall 146 (not shown), by a pair of spaced apart fasteners 152, 154, for example, threaded bolts. Fastener 154 secures a wheel axle 156 about which there is rotationally supported a wheel 158 by means of a bearing assembly 160. A portion of the wheel 158 extends below the bottom 142 of the cart 138 so as to provide movable support for the cart.

Extending outwardly through the sidewalls 144, 146 is a side wheel bearing housing 162 which receives a cotterless self-locking pin 164. The pin 164 functions as an axle for rotationally supporting side guide wheel 166 having a portion extending beyond the side wheel bearing housing 162. The side guide wheel 166 may be spring loaded to accommodate tolerance mismatches as to be described hereinafter. As a result of this arrangement, the pin 164 has its longitudinal axis arranged transverse to the longitudinal axis of wheel axle 156. As such, the wheel 158 and guide wheel 166 rotate in transverse planes. The construction of the wheel assembly 148 is generally completed by providing a needle board cushion 168 along the top edge 170 of the wheel housing 150. At this location, the wheel housing 150 is provided with a projection 172 extending upwardly from the top edge 170 terminating beyond the height or thickness of the needle board cushion 168. The needle board cushion 168 can be constructed from a variety of preferably synthetic resilient or compressible materials such as polymer materials which have a certain degree of compressibility to take up mismatched tolerances between the needle board 126 and needle beam modules 116 which will become apparent from a further description of the present invention.

Figure 5:
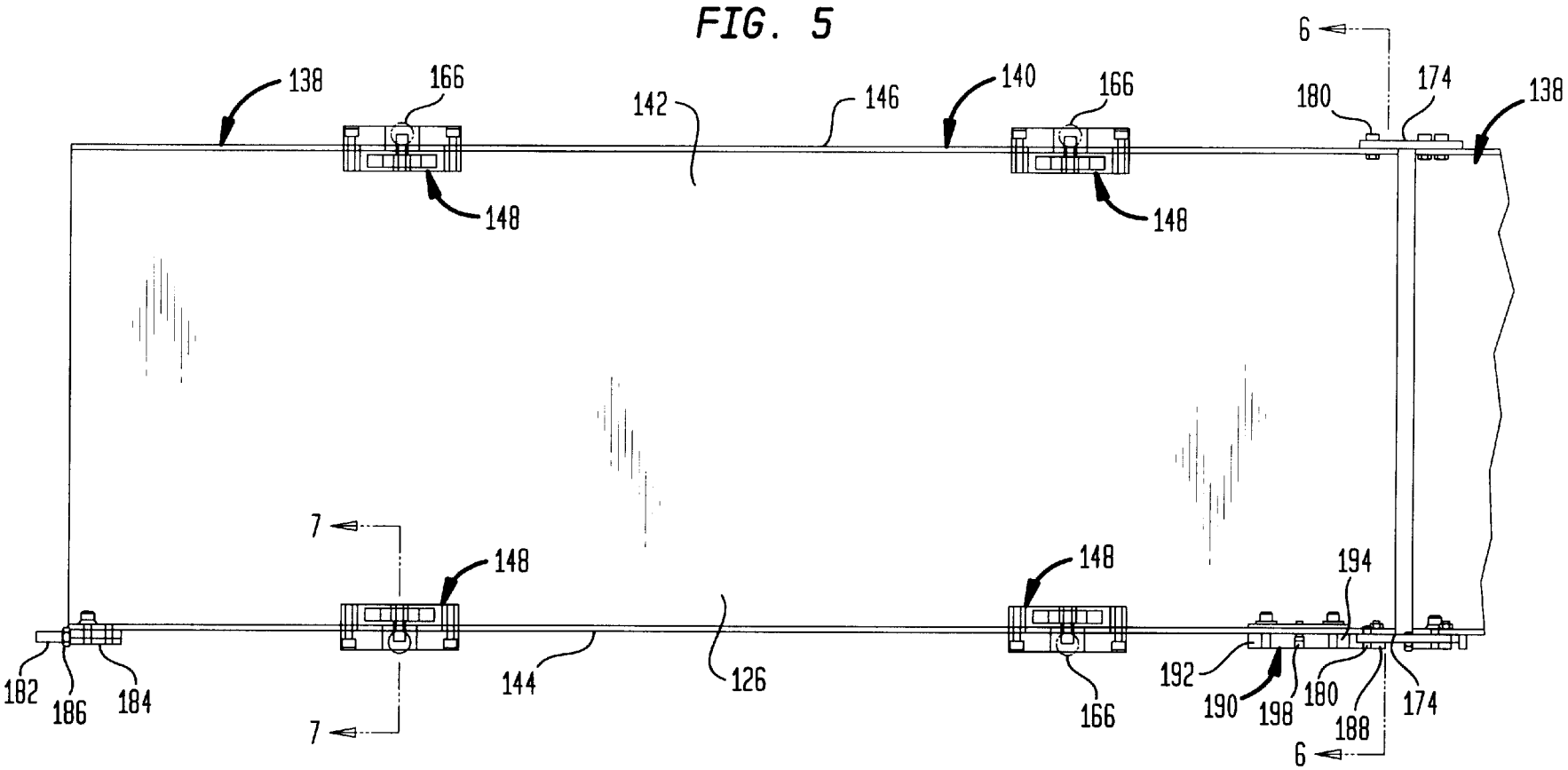
FIG. 5 is a top plan view of a needle board cart.

A pair of needle board carts 138 may be releasably connected in end to end relationship by a latch 174. As shown in FIGS. 4 and 5, one end of the latch 174 is journaled for rotation about a shaft 176 attached adjacent the free end of the sidewalls 144, 146 of the cart 138. The other end of the latch 174 includes an opening 178 sized to capture a pin 180 attached to the sidewalls 144, 146 of an adjacent needle board cart 138. The opening 178 has dimensions slightly greater than the dimensions of the pin 180 thereby allowing slight longitudinal movement between adjacent needle board carts 138 when attached in end-to-end relationship. As an alternative to the latch 174, the carts 138 may be connected together by a chain or leaf spring latch.

The needle board carts 138 may be maintained in predetermined spaced apart end to end relationship by means of a spacer rod 182 extending longitudinally outward from one of the sidewalls 144, 146 at the end thereof. The spacer rod 182 is attached to the sidewall 144 by means of a mounting bracket 184. The spacer rod 182 may be in the nature of a threaded rod such that its protruding length beyond the end of the sidewall 144 may be adjusted and ultimately locked in place by means of a threaded retaining nut 186. A stop plate 188 is attached to the sidewall 144 of the needle board cart 138 opposing the spacer rod 182. As best shown in FIG. 4, the leading edge of the spacer rod 182 will engage a portion of the stop plate 188 thereby maintaining the adjacent needle board carts 138 in predetermined spaced apart relationship. Although the needle board cart 138 has been described with respect to the incorporation of a single spacer rod 182, it is to be understood that an additional spacer rod may be provided on the other sidewall 146 if desired.

Figure 14:
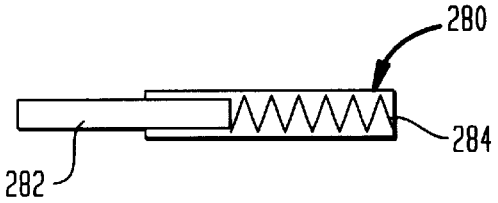
FIG. 14 is a diagrammatic illustration of a spacer rod in accordance with another embodiment of the present invention.

Another embodiment of a spacer rod 280 is diagrammatically illustrated in FIG. 14. The spacer rod 280 is provided with a spring loaded plunger or stop member 282 by means of compression spring 284. The stop member 282 is biased against a preloaded spring force and to extend outwardly a predetermined distance. In the event the pitch or distance between adjacent needle board carts 138 is other than the preset distance, the spacer rod 280 will compress against preloaded spring 284 to accommodate a smaller pitch between the carts. A plurality of spacer rods 280 may be provided on the carts 138 as previously noted with respect to spacer rod 182. In addition, the stop plate 188 as previously described may also be in the form of a spacer rod 280 which is spring loaded or in the nature of a spacer rod 182 which is mechanically adjustable.

An alignment/locator plate 190 is attached to at least one end of one of the sidewalls 144, 146 of the needle board cart 138. The alignment/locator plate 190 includes a pair of upwardly extending spaced apart fingers 192, 194 which define therebetween an elongated opening 196 in the nature of a slot. The opening 196 extends from a location adjacent the top edge of sidewall 144 to the free end of the fingers 192, 194 where there is provided an expanding or diverging enlarged opening 198 bound by sloping sidewalls 200. The enlarged opening 198, via the sloping sidewalls 200 and its expanding or diverging shape, facilitates access to the elongated narrow opening 196 which is arranged traversed to the top edge of the sidewalls 144, 146 of the needle board cart 138.

The alignment/locator plate 190 as thus far described in accordance with one embodiment includes fingers 192, 194 extending upwardly to provide the elongated opening 196. It is to be understood that other constructions and arrangements of the alignment/locator plate so as provide an opening or other alignment means as will be further understood from a description of the present invention are contemplated within the scope of the present invention. Although only a single alignment/locator plate 190 has been described, it is to be understood that a plurality of alignment/locator plates may be attached at various portions of the sidewalls 144, 146 of the needle board cart 138.

Figure 15:
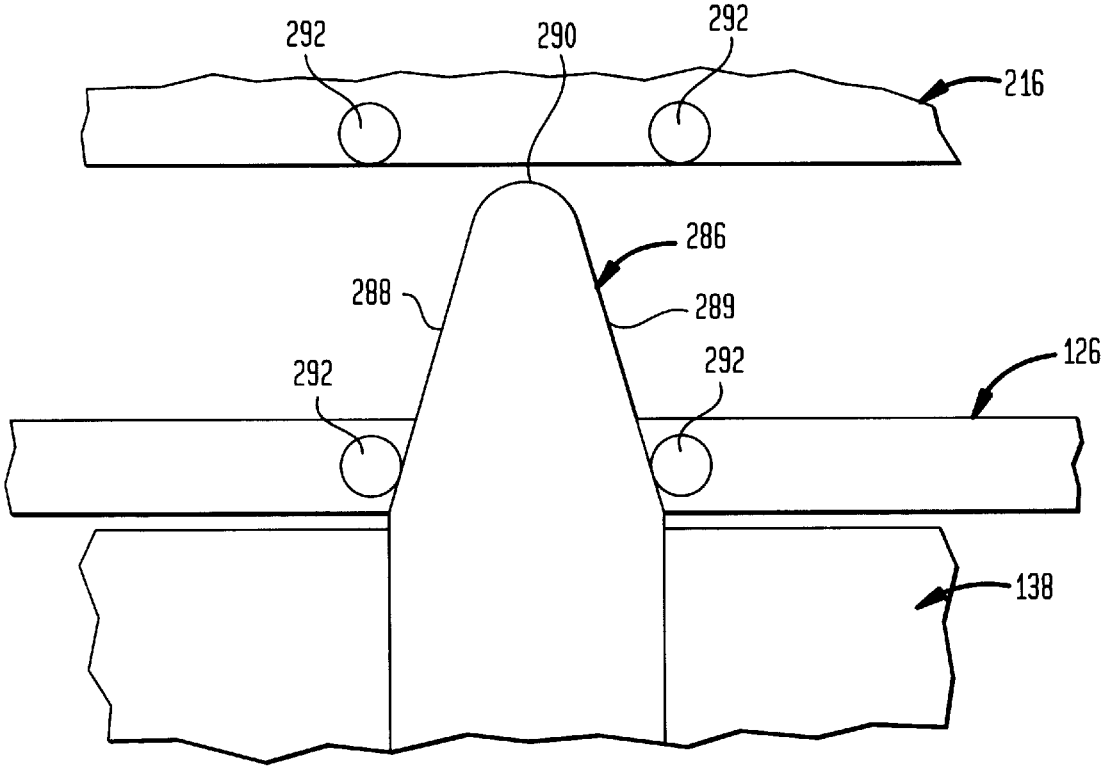
FIG. 15 is a diagrammatic illustration of an alignment/locator plate in accordance with another embodiment of the present invention.

In accordance with another embodiment as shown in FIG. 15, an alignment/locator plate 286 has a triangular shape formed from two sloping sidewalls 288, 289 which converge to a rounded tip 290. The needle board 126 is provided with a pair of spaced apart extending pins 292 similar to pins 204. The pins 292 are spaced apart a distance approximately the same as the widest point on the alignment/locator plate 286. At this point, the needle board 126 will be supported by the wheel assemblies 148. By providing the alignment/locator plate 286 as a tapered cone-shaped member, the spaced apart pins 292 are operative for providing alignment between the needle board 126 and the needle board cart 138. It is to be understood that a similar pair of spaced apart pins 292 can be provided on the needle beam module 116 to provide similar alignment as to be described hereinafter with respect to the alignment/locator plate 190.

Figure 16:
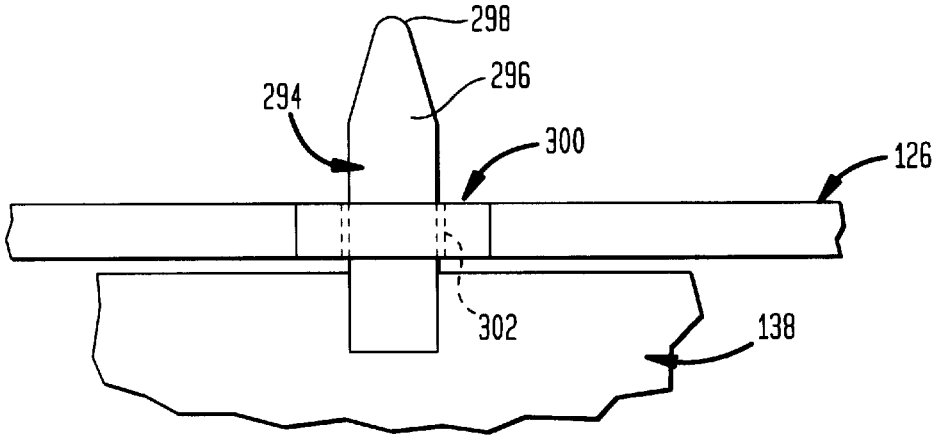
FIG. 16 is a diagrammatic illustration of an alignment/locator plate in accordance with another embodiment of the present invention.

In accordance with another embodiment as shown in FIG. 16, an alignment/locator plate 294 is in the nature of an elongated cylindrical pin 296 having a cone-shaped end 298. An extension 300 is attached extending outwardly from the needle board 126 having a generally circular opening 302 corresponding to the shape of the pin 296. The opening 302 is sized so as to provide a sliding fit over the pin 296. Alignment is facilitated by means of the cone-shaped end 298. A similar extension (not shown) may be provided on the needle board module 116 to effect similar alignment with the needle board cart 138.

Figure 6:
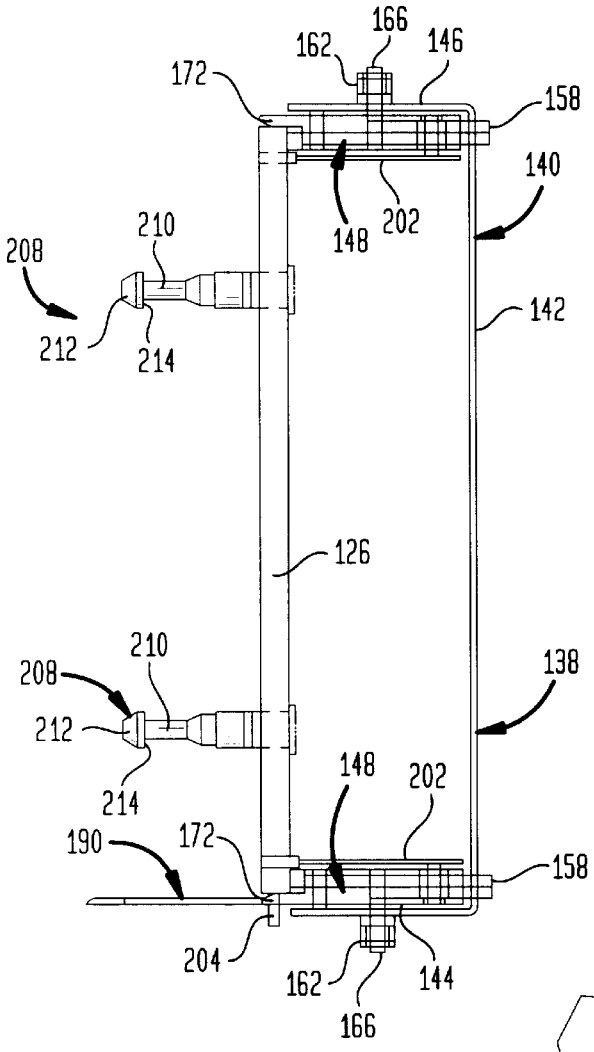
FIG. 6 is a cross-sectional view of the needle board cart taken along line 6—6 in FIG. 5 further showing a needle board being supported thereon and an alignment/locator plate.

The needle board 126 as best shown in FIGS. 4 and 6, includes a plurality of attached downwardly depending needles 202 as conventionally known in the needle loom art. Although only a few needles 202 are illustrated, it is to be understood that the needles are generally arranged in a matrix or other arrangement across the entire surface of the needle board 126 so as to accomplish the needling process pursuant to the operation of the needle loom 100. For each alignment/locator plate 190, the needle board 126 is provided with a laterally outwardly extending locator pin 204 generally from one side edge 206 of the needle board. The pin 204 is dimensioned so as to be received in sliding fit within the elongated opening 196 of the alignment/locator plate 190. In this regard, the diameter of the pin 204 is slightly smaller than the width of the elongated opening 196.

As the needle board 126 is positioned in supporting relationship on the needle board cart 138, the alignment pin 204 is initially received within the enlarged opening 198 of the alignment/locator plate 190. The enlarged opening 198 facilitates capturing of the pin 204 so as to guide same via the sloping sidewalls 200 into the elongated opening 196. In final position, the needle board 126 is supported by its side edges generally by the needle board cushion 168 in the vertical direction and horizontally by the projections 172 of the wheel assembly 148 as best shown in FIG. 7. As previously noted, the needle board cushion 168 is operative due to its resilient nature to compress and take up any tolerance mismatch with the needle beam modules 116 during attachment as to be described. By virtue of the alignment/locator plate 190 and alignment pins 204, a needle board 126 may be accurately positioned in precise alignment or registration with the needle board cart 138. This alignment, as to be described hereinafter, can be carried through so as to accurately position and align the needle board 126 to its corresponding needle beam module 116.

The needle boards 126 are further provided with a plurality of attachment members 208 which are operative for attaching and aligning the needle board to its corresponding needle beam module 116. The attachment members 208 are generally in the nature of an elongated cylindrical pin having a reduced diameter portion 210 and a terminal end 212 having an effective diameter larger than the reduced diameter portion. The terminal end 212, adjacent the reduced diameter portion 210, is provided with a circumscribing lip 214. Although the attachment members 208 have been described as elongated cylindrical pins, such members may have other cross sectional shapes, for example rectangular, oval and the like. In any event, a plurality of attachment members 208 are attached to the needle board 126 extending upwardly from its top surface opposite the needles 202. As specifically shown, the longitudinal axis of the attachment members 208 are arranged generally parallel to each other and transverse to the plane containing the needle board 126.

Figure 8:
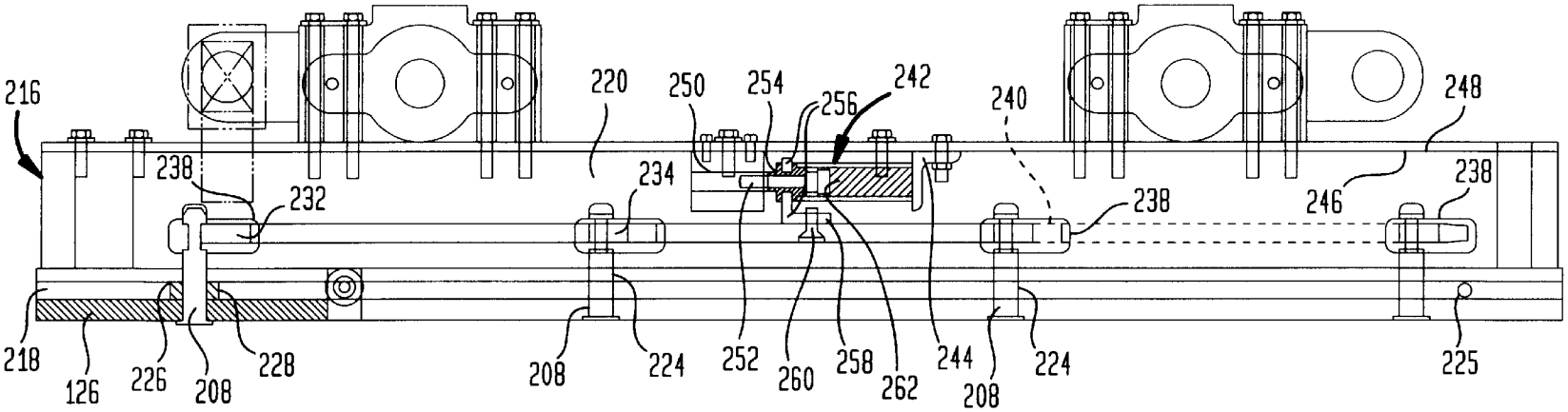
FIG. 8 is a side elevational view in partial cross-section of a needle beam module including a clamp plate assembly constructed in accordance with one embodiment of the present invention.
Figure 9:
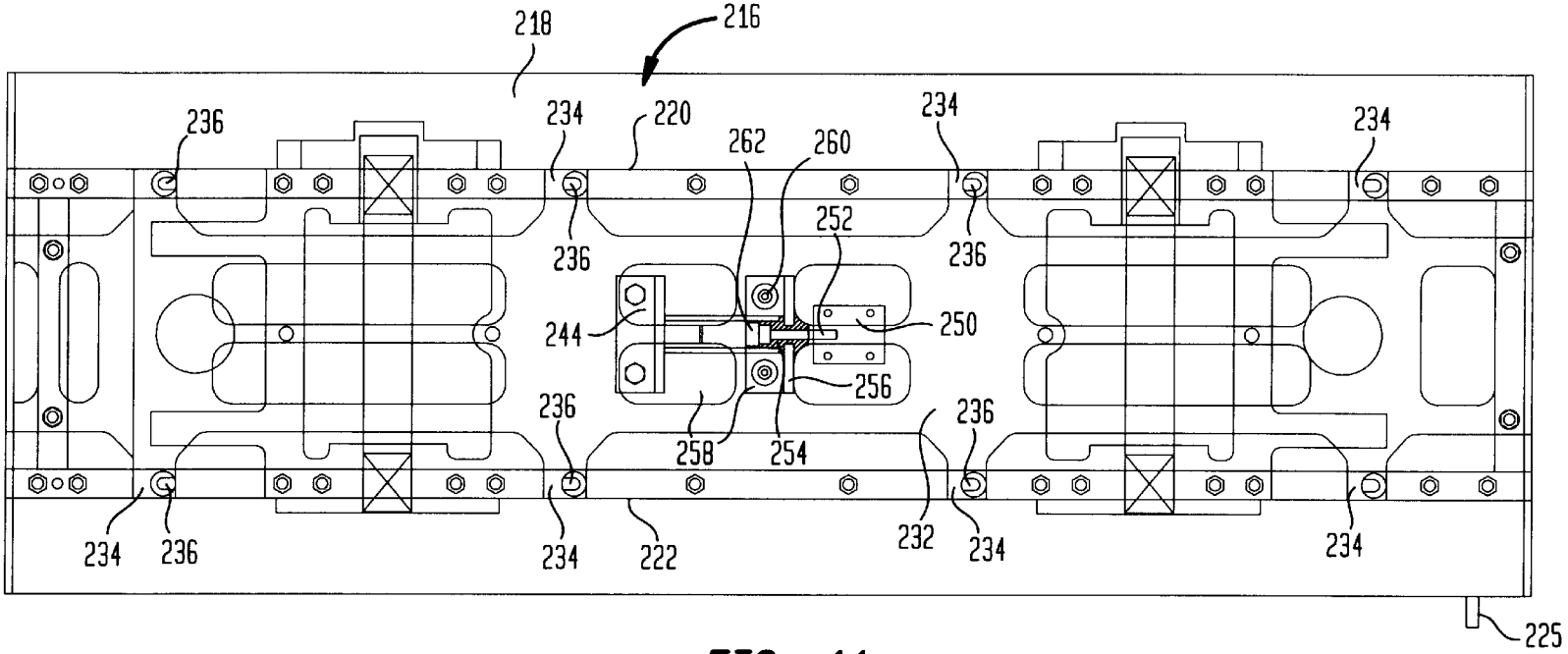
FIG. 9 is a top plan view of the needle beam module.

The attachment members 208 cooperate with the needle beam modules 116 for securing the needle boards thereto. Referring to FIGS. 8 and 9, each of a plurality of needle beam modules 116 is constructed to include a needle beam 216. The needle beam 216 is generally constructed from a planar support plate 218 from which there upwardly extends a pair of spaced apart sidewalls 220, 222. The support plate 218 is provided with a plurality of openings 224, 226, 230 arranged in alignment with the locations of the attachment members 208 on the needle board 126. An outwardly extending pin 225 is positioned on one side edge of the support plate 218. As will be described hereinafter, the pin 225 is operative with the alignment/locator plate 190 to assist in the alignment of the needle board 126 with the needle beam 216 during the needle board replacement process.

Figure 10:
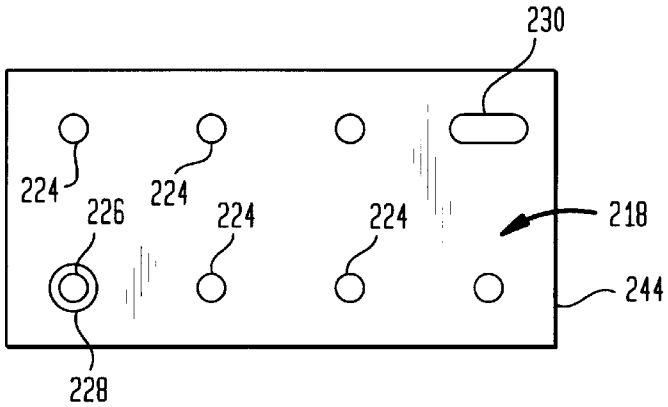
FIG. 10 is a top plan view of the support plate of the needle beam within the needle beam module showing a plurality of alignment openings in accordance with one embodiment of the present invention.

The arrangement of the openings 224, 226, 230 are diagrammatically shown in FIG. 10. The openings 224 are generally circular in nature and specifically larger than the effective diameter of the attachment members 208 to allow easy passage therethrough even if slightly out of alignment. At least one opening 226 is provided with a donut shaped polymer bushing 228 (or other suitable material) wherein the opening conforms to the effective diameter of its corresponding attachment member 208. It is to be noted that the bushing 228 which is intended to prevent wear may be omitted if desired. At least elongated opening 230 is provided in the support plate 218 having its long axis substantially greater than the effective diameter of the corresponding attachment member 208, while having its transverse axis substantially the same as the effective diameter of the corresponding attachment member. A similar bushing may be provided in the opening 230.

As previously described, the openings 224, 226, 230 are operative for receiving the attachment members 208 which extend upwardly from the needle board 126. Openings 226, 230 are specifically designed to effect alignment of the needle board 126 with the needle beam 216 during the installation process. Since the effective diameter of the opening 226 created by the bushing 228 generally corresponds to the effective diameter of the attachment member 208, the opening provides accurate positioning of the needle board 126 in the x and y directions, and hence, in a radial direction. It is noted that the enlarged openings 224 generally provide for gross alignment allowing the attachment members 208 to be movable therein when positioning the needle board 126 in alignment with the needle beam 216. Enlarged openings 224 allow for machining/manufacturing tolerances and thermal expansion, while allowing support of the load of the needle boards 126, but not affecting registration.

The elongated opening 230 due to its transverse axis corresponding generally to the dimension of the attachment member 208 provides alignment of needle board 126 in the theta direction. In other words, the elongated opening 230 prevents angular rotation of the needle board 126 about opening 226 which would otherwise be permitted due to the enlarged openings 224. By virtue of the opening 230 being elongated, this facilitates positioning of the attachment member 208 within the opening. Accordingly, the construction of the openings 224, 226, 230 facilitate receipt of the attachment members 208 therein, while at the same time, enabling accurate alignment and positioning of the needle board 126 in registration with the needle beam 216.

Figure 11:
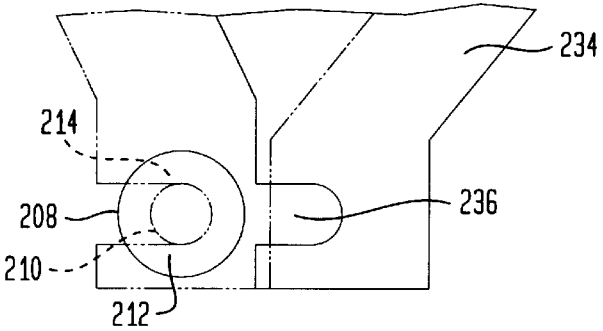
FIG. 11 is a partial top plan view of a portion of the clamp plate assembly operative for engaging a portion of a needle board in accordance with one embodiment of the present invention.
Figure 12:
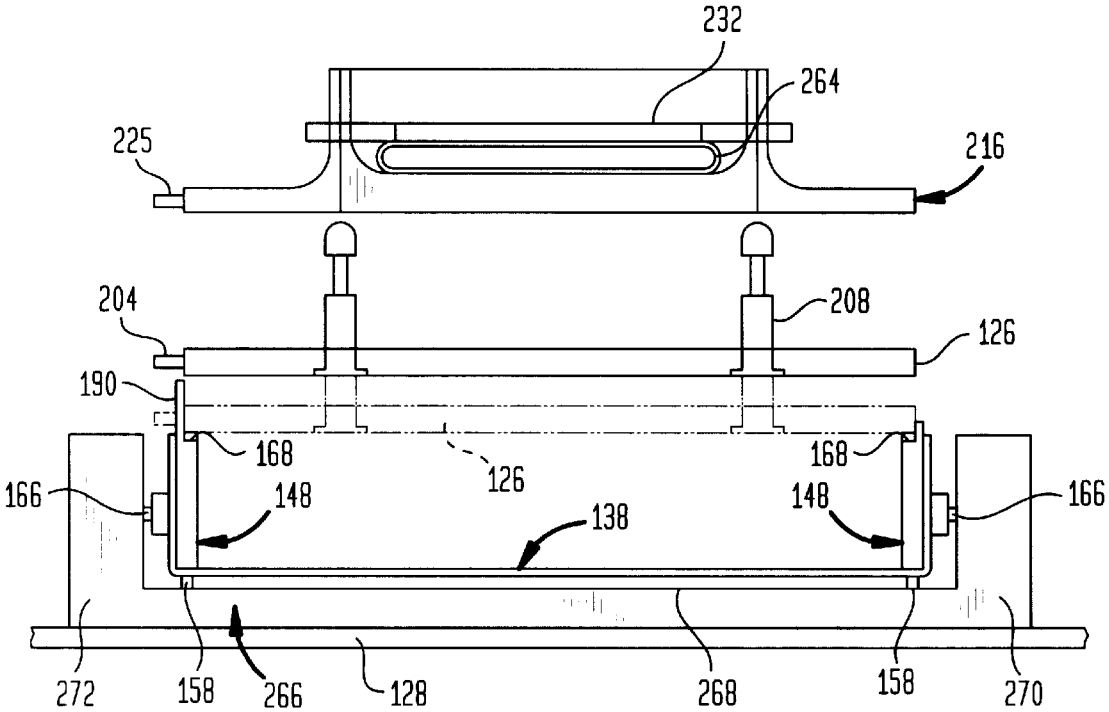
FIG. 12 is a diagrammatic illustration showing a needle board cart being positioned in relationship to a needle beam in accordance with the method of the present invention.

A clamp plate assembly having a clamp plate 232 is positioned within the needle beam 216 between the sidewalls 220, 222 overlying the support plate 218. The clamp plate 232 is in the nature of a flat elongated member having wings 234 each provided with an opening 236, as best shown in FIGS. 9 and 11. The wings 234 extend laterally outward a sufficient distance such that the openings 236 are in longitudinal alignment with the attachment members 208 extending upwardly from an underlying needle board 126. The clamp plate 232 is reciprocally supported within the needle beam 216 between first and second positions for engaging the attachment member 208 by means of the openings 236 in the wings 234.

As shown in FIG. 11, the clamp plate 232 is reciprocal from a first position shown in solid lines whereby the wings 234 are positioned adjacent a corresponding attachment member 208 with its opening 236 in alignment with the reduced diameter portion 210 of the attachment member. Upon reciprocating of the clamping plate 232, the wings 234 will move to a position as shown in phantom whereby the openings 236 receive the reduced portion of its associated attachment member 208. The lip 214 provided by the attachment member 208 is supported on that portion of the wing 234 surrounding the opening 236.

Figure 17:
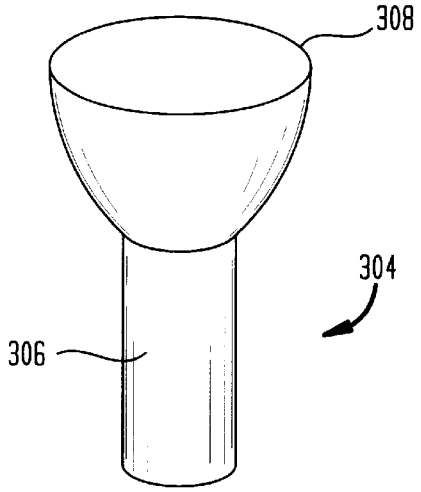
FIG. 17 is a perspective view of an attachment member constructed in accordance with another embodiment of the present invention.

In accordance with another embodiment of the present invention as shown in FIG. 17, the attachment members 304 have a generally y-shape. In this regard, the attachment members 304 are generally provided with a uniform cylindrical body 306 to which there is attached an inverted cone-shaped member 308. The cone-shaped member 308 is operative for being engaged by the openings 236 in the wings 234 during operation of the clamp plate 232.

In the engaged position, the needle board 126 becomes attached to or suspendable from the needle beam 216 via the attachment members 208 engagement with the wings 234 of the clamp plate 232. The engaged and disengaged orientation of the clamp plate 232 to the attachment members 208 can also be seen through the openings 238 in the sidewall 220 of the needle beam 216 as shown in FIG. 8. As shown in the second opening from the right, wing 234 is in its clamped position about the attachment member 208, as well as in a disengaged position 240 as shown in phantom.

The clamp plate 232 is reciprocally slided within the needle beam 216 by means of an actuating mechanism 242. The actuating mechanism 242 includes a support frame 244 which is attached to the bottom surface 246 of a needle beam cover 248 which is bolted to the sidewalls 220, 222. A pneumatic cylinder 250 having an outwardly extending reciprocal piston rod 252 is attached to the bottom surface 246 of the needle beam cover 248. A bushing 254 is secured to the piston rod 252 for capturing an actuating bar 256. One end 258 of the actuating bar 256 is coupled to the clamp plate 232 by means of pin 260 such as a flat head screw. Upon actuation of the pneumatic cylinder 250, the actuating bar 256 will effect movement of the clamp plate 232 between engaged and disengaged positions with the attachment members 208.

A compression spring 262 within the actuating mechanism 242 maintains the actuating bar 256 in a forward position whereby the clamp plate 232 would be normally engaged with the attachment members 208. Disengagement of the clamp plate 232 is achieved by actuation of the pneumatic cylinder 250 against the force of the compression spring 262. The compression spring 262 acts a failsafe device to maintain the clamp plate 232 in its engaged position in the event of failure of the actuating mechanism 242 or other components and/or assemblies of the needle beam 216. In addition to the pneumatic cylinder 232, a solenoid linear motor or spring assembly could be used.

An actuating device such as an inflatable device 264 is positioned within the needle beam 216 between the support plate 218 and clamp plate 232. Upon inflation of the device 264, the clamp plate 232 is caused to move upwardly while supporting the needle board 126 by means of the attachment members 208. Upward movement of the clamp plate 232 will continue until the needle board 126 is compressed against the bottom surface of the support plate 218 of the needle beam 216. To accommodate the upward movement of the clamp plate 232, the actuating bar 256 is provided with a U-shaped opening which partially engages the bushing 254 provided on the piston rod 252. This opening is sized sufficiently to accommodate the degree of vertical movement required by the clamp plate 232. The needle board 126 is maintained in secured attachment to the needle beam 216 as long as the device 264 is inflated. In accordance with one embodiment, the device 264 is a resilient inflatable bladder. It is to be understood that any other mechanism or actuator which is operative for displacing the clamp plate 232 upwardly, e.g., linear motion, as thus far described is suitable for use in the present invention, for example, a cam, pneumatic cylinders, magnetic or electromagnetic actuators and the like.

The present invention as thus far described includes a plurality of needle board carts 138 which are operative for moving into and out of the needle loom 100 into a position in alignment with the plurality of needle beams 216. Each of the needle board carts 138 removably supports a needle board 126 having a plurality of attachment members 208. The needle board carts 138, each supporting a needle board 126, are moved into the needle loom 100 in end-to-end relationship being releasably interconnected by means of the latch 174. The needle boards 126 are aligned with respect to their underlying cart 138 by means of the alignment/locator plate 190. The spacing between the needle board carts 138 is maintained by the spacer rod 182 abutting an adjacent cart.

Once the needle board carts 138 have been positioned within the loom 100, the carts 138 are raised by the stripper plate 266 until the attachment members 208 penetrate the openings 224, 226, 230 in the support plate 218. The needle board 126 is aligned with the support plate 218 by the pin 225 being captured in the elongated opening 196 of the alignment/locator plate 190 on the cart 138. The attachment members 208 are then engaged by actuation of the clamp plate 232 by operation of the actuating mechanism 242. Finally, the needle boards 126 are secured to the needle beam 216 by inflation of the bladder 264. The needle board carts 138 are withdrawn from the needle loom 100 in end-to-end relationship by their interconnection by means of the latches 174. The process as thus far described, in addition for installing needle boards 126, can also be used when removing needle boards such as for repair and replacement.

Figure 13:
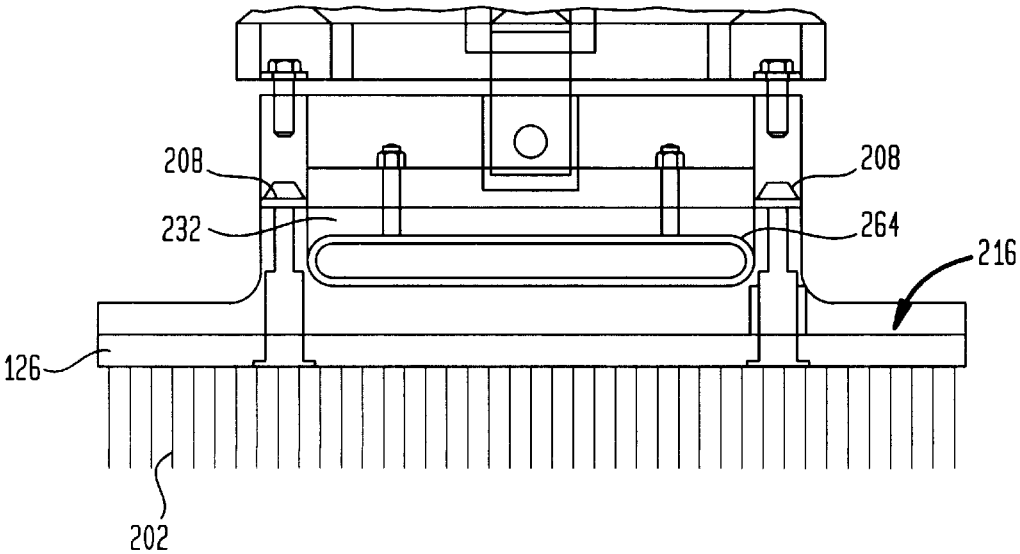
FIG. 13 is a diagrammatic illustration of a needle board being attached in alignment to a needle beam in accordance with the method of the present invention.

The construction of the present invention having now been described, a more detailed description of the method for installing and removing needle boards 126 from a needle loom 100 will now be described with reference to FIGS. 13–14. The needle loom 100 is initially locked into a maintenance mode. A plurality of needle board carts 138, one for each needle board 126 to be inserted into the needle loom 100 are generally positioned near the end of the needle loom which provides access to the needle beam modules 116 in either the upper or lower needle board zones 118, 120. A needle board 126 is positioned onto a needle board cart 138 in alignment therewith as thus far described. In this regard, the pin 204 of the needle board 126 is received within the elongated opening 196 of the alignment/locator plate 190. The needle board 126 is supported by the needle board cushion 168 provided on each of the wheel assemblies 148. As a result, the load of the needle boards 126 are carried by the wheel assemblies 148 as opposed to the frame 140 of the needle board cart 138. This results in the construction of a no load frame when supporting the needle boards 126. The alignment/locator plate 190 provides for semi-accurate registration of the attachment members 208 with respect to the needle board cart 138.

The first needle board cart 138 is inserted, for example, into the upward needle board zone 118 of the needle loom 100. Specifically, the needle board cart 138 will be positioned within the needle loom stripper plate 266 as illustrated in FIG. 13. As is conventional in the operation of a needle loom 100, the stripper plate 266 includes a bottom wall 268 and a pair of spaced apart sidewalls 270, 272. The stripper plate 266 is generally maintained in a stationary position during the operation of the needle loom 100. In this regard, the stripper plate 266 restrains on its underlying surface the endless fabric web 128 during operation of the needle loom 100. Although not shown, it is understood that the bottom wall 268 is provided with a plurality of holes which are aligned with the needles 202 extending from the needle board 126. The stripper plate 266 is movable in a vertical direction to provide separation between an underlying bed plate (not shown) to provide more space therebetween for removing the endless fabric web 128.

The needle board cart 138 is rollably supported on the bottom wall 268 of the stripper plate 266 by means of wheels 158. Lateral positioning or restraint of the needle board cart 138 is achieved by wheels 166 rollably engaging the sidewalls 270, 272 of the stripper plate 266. The position of the needle board 126 with respect to the needle board cart 138 is shown in phantom in FIG. 13.

A second needle board cart 138 is coupled to the first needle board cart by means of latch 174 engaging the pin 180 of the adjacent cart. As previously described, the latch provides a certain degree of relative motion between the adjacent carts 138. The precise distance between the adjacent carts 138 is maintained by the spacer rod 182 of one cart abutting against the stop plate 188 or another spacer rod 182, 280 of an adjacent cart. The spaced apart distance may be adjusted by means of the retaining nut 186 by which the spacer rod 182 may be extended or contracted or the spring loading of spacer rod 280. In this manner, a plurality of needle board carts 138 are linkable together in end-to-end relationship and inserted into the needle loom 100 in respective upper and lower needle board zones 118, 120, each supporting a needle board 126. The semi-accurate cross machine direction positioning of the needle board carts 138 within the loom 100 will be established by the spacer rod 182 of the lead cart abutting against a portion of the stripper plate at the end of the needle loom. This will effect registration of each of the needle board carts with respect to an associated needle beam 216.

The alignment as thus far described will position each of the attachment members 208 in relative alignment with the plurality of openings 224, 226, 230 within the needle beam 216. The needle board cart 138 and its supported needle board 126 are raised upwardly by operation of the stripper plate 226. The needle boards 126 are semi-precisely aligned with the needle beam 216 by the pin 225 being captured by the alignment/locator plate 190, and specifically, within the elongated opening 196. Once the attachment members 208 reach a position in operative association with the clamp plate 232 after penetrating the openings 224, 226, 230 in the support plate 218, the actuating mechanism 242 is operated to engage the attachment members. The attachment members 208 engage into openings 226, 230 for precision alignment and positioning of the needle board 126 with respect to the needle beams 216. In this regard, the clamp plate 232 is displaced laterally whereby the reduced diameter portions 210 of the attachment members 208 are received within the openings 236 within the wings 234 of the clamp plate as shown in phantom in FIG. 11. As such, the needle board 126 may be in a suspended state with respect to the clamp plate 232, although temporarily clamped to the beam by the stripper plate 266.

At this time, the stripper plate 266 may be returned to its original position within the needle loom 100 whereby the needle board 126 remains suspended from the needle beam 216. Preferably, the stripper plate 266 will be used to temporarily clamp the needle board 126 to the needle beam 216. Subsequently, the bladder 264 or other device will be inflated/actuated so as to effect secured attachment of the needle board 126 to the needle beam 216, whereupon the stripper plate 266 may be lowered for removal of the needle board carts 138. The unloading of the needle boards 126 from the needle beams 216 is accomplished in a reverse manner whereby, for example, the needle boards are supported by the stripper plate 216 prior to deflating or deactivating the bladder 264.

The needle board 126 is thus securely clamped to the needle beam 216 by inflating the bladder 264. In this regard, the bladder 264 being supported by the needle beam 216 will force the clamp plate 232 upwardly drawing the needle board 126 against the support plate 218 of the needle beam 216. Subsequently, the needle board carts 138 are withdrawn from the upper and lower needle board zones 118, 120 as the carts are maintained in linked end-to-end relationship by means of the latch 174.

As described, the alignment of the needle board 126 to the needle beam 216 is accomplished from the invention as thus far described. In particular, the needle board 126 is aligned with a respective needle board cart 138 by means of pin 204 being engaged by the alignment/locator plate 190. The needle board carts 238 are maintained in spaced apart relationship by means of the spacer rod 182. Finally, the needle board cart 126 is aligned with respect to the needle beam 216 by means of pin 225 being captured by the alignment/locator plate 190 and the precise alignment of members 208 being received in the openings 226, 230 of the support plate 218.

Accordingly, the positioning and aligning of the needle boards 126 with respect to the respective needle beams 216 is achieved without operator intervention thereby assuring accuracy, as well as minimizing needle loom downtime.

The removal of the needle boards 126 from the loom 100 may be achieved by reversing the process as thus far described. Specifically, a plurality of empty needle board carts 138 are connected in end-to-end relationship by means of the latch 174 and inserted into the upper and lower needle board zones 118, 120. The stripper plate 270 is raised to position each of the needle board carts 138 underlying the needle beam 216 and temporarily clamps the needle board 126 to the needle beam 216. Upon deflating of the bladder 264, the needle boards 126 will be in a supporting position on an underlying needle board cart 138. The clamp plate assembly will be disengaged allowing removal of the needle board 126 upon lowering of the stripper plate 270. The loaded needle board carts 138 may be withdrawn from the needle loom 100 in their original end-to-end relationship due to their interconnection via the latch 174.

The needle board carts 138, with or without the needle boards 126 may be stored within an apparatus of the type as disclosed in the '023 Application. The needle board carts 138 may be stored in the two stage magazine in the same manner as the disclosed needle boards 126. The two stage magazine can be operated in a similar manner as disclosed in the '023 Application for insertion and removal of needle boards 126 with their associated needle board cart 138 for storage therein.

As thus far described, the needle boards 126 are aligned with the needle board modules 116 in a three step positioning process. First, the spacing between the needle boards 116 is achieved by means of the spacer rods 182, 280 to provide semi-accurate positioning of the needle boards within the needle loom 100. Additionally, the alignment/locator plate 190, 286, 294 also provide semi-accurate positioning of the needle boards 126 with respect to the needle board carts 138 and the needle beams 216. The third alignment step provides precise alignment of the needle boards 116 with the needle beams 216. This is achieved by the attachment members 208 being received within the openings 226, 230 as thus far described.

As shown in FIG. 7, the needle boards 126 are aligned in the machine direction by means of the construction of the needle board cart 138 and its cooperation with the stripper plate 266. The needle board cart 138 is semi-precisely positioned in the machine direction between the sidewalls 270, 272 of the stripper plate 266 by engagement with the guide wheels 166 of the wheel assemblies 148. In this regard, the inner surfaces of the sidewalls 270, 272 may be machined surfaces along which the guide wheels 166 travel. By spacing the interior surfaces of the sidewalls 270, 272 at the same distance between the exterior surfaces of the guide wheels 166, the needle board cart 138 will be semi-precisely registered therewith. As previously noted, the guide wheels 166 may be spring loaded so as to accommodate tolerance mismatches in the construction of the aforementioned components.

The needle boards 126 are aligned with respect to the needle board carts 138 in the machine direction, and hence the needle beam modules 116, by being positioned between the projections 172 which extend upwardly from the top edge 170 of the wheel assemblies 148. From the foregoing construction of the present invention as thus far described, the needle boards 126 are aligned with respect to the needle beam modules 116 in both the machine direction, as well as the cross machine direction.

Figure 18:
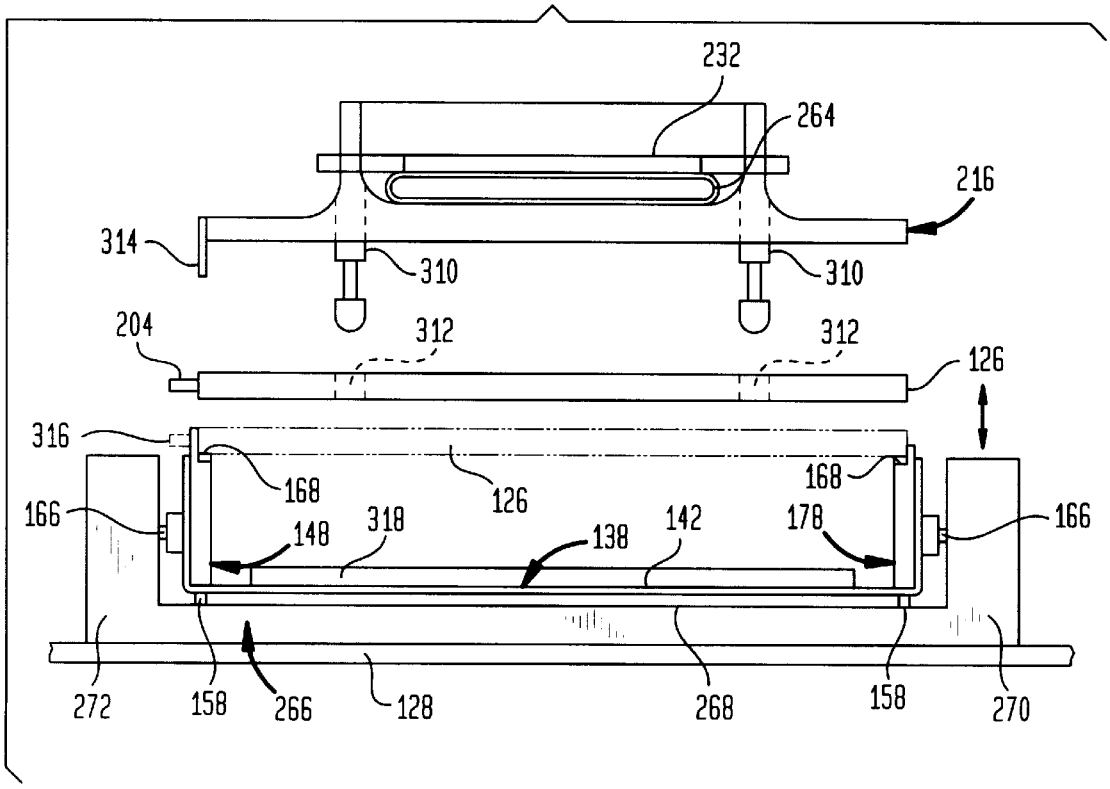
FIG. 18 is a diagrammatic illustration showing a needle board cart being positioned in relationship to a needle beam in accordance with another embodiment of the present invention.

Referring now to FIG. 18, there is disclosed another embodiment of the present invention. As shown, attachment members 310 of a similar nature to the attachment members as thus far described, are secured to the clamp plate 232 extending downwardly from the needle beam 216. A plurality of corresponding aligned openings 312 are provided in the needle board 126. The openings 312 can be similar in shape and location as described with respect to openings 224, 226, 230 which were provided in the support frame 244 of the needle beam 216 as shown in FIG. 10. From the foregoing description, it will be appreciated that the arrangement of the attachment members 312 is just the opposite as previously described wherein the attachment members 208 were secured to the needle board 126. In a similar operation, the attachment members are engaged within the openings 312 of the needle board 126 by movement of the clamp plate 232.

An alignment/locator plate 314 may be attached to the needle beam 216 in addition to or instead of the alignment/locator plate 190 secured to the needle board cart 138. As the needle board cart 138 and needle board 126 are raised by means of the stripper plate 266, the alignment/locator plate 314 will capture, for example, pin 204 extending from the needle board 126 and a pin 316 provided on the needle board cart. As such, the alignment/locator plate 314 will effectively semi-precision align the needle board 126 to the needle beam 216 in a similar manner as previously described with respect to the alignment/locator plate 190. It is to be understood that other arrangements in forms of the alignment/locator plate 314 may be used, for example, as described with respect to the alignment/locator plates 286 and 294 as shown in FIGS. 15 and 16. It should be appreciated that an alignment/locator plate 190 may also be provided on the needle board cart 138 for initially aligning the needle board 126 thereto. Another alignment/locator plate 314 may be provided on the needle beam 216 for receipt of a pin or other capturable member provided on the needle board 126 and/or needle board cart 138. As such, various arrangements of the alignment/locator plates and pins may be provided on the needle beam 216, needle board 126 and needle board cart 138 to achieve semi-precision alignment as previously described.

As further shown in FIG. 18, and as previously described, the needle board cart 138 is supported by the stripper plate 266 for raising and lowering the cart for clamping the needle board 126 to the needle beam 216. The needle board cart 138 may be provided with a lifting mechanism 318 which is diagrammatically illustrated, by way of example, attached to the bottom wall 142 of the cart. The lifting mechanism is operative for raising the needle board cart 138 and supported needle board 126 into operative association with the needle beam 216 as thus far described with respect to the stripper plate 266. Hence, the lifting mechanism 318 may be constructed in any mechanical form which would perform the aforementioned function, for example, a scissors jack, pneumatic cylinders, or other similar devices. Although the method of the present invention has been described with respect to movement of the stripper plate 266 for lifting the needle board cart 138 and needle board 126 upwardly to operative association with the needle beam 216, it is also possible to move the needle beam 216 downward, or a combination of both via the stripper plate 216 and/or lifting mechanism 318 to effect clamping of the needle board to the needle beam. It should therefore be appreciated that the present invention may provide a variety of movements of the needle beam 216, stripper plate 266 and/or lifting mechanism 318, either alone or in various combinations, to effect attachment of the needle board 126 to the needle beam 216 by the clamping action of the clamp plate 232.

The attachment members 208, 304, 310 have been illustrated and described as having various shapes. For example, it is further contemplated that the attachment members may have a diamond shape formed from two transverse axes, one axis being longer than the other. The diamond shaped attachment members are receivable within circular openings provided either within the needle board 126 or needle beam 216 as thus far described. By providing at least two attachment members having a diamond shape received within a circular opening, precision alignment of the needle board 126 to the needle beam 216 can be achieved.

It is also contemplated that the needle board cart 138 can be in the nature of a "smart" cart which could be programmed to propel, elevate and align precisely to the needle beam 216 by itself using, for example, proximity sensors or other like devices and suitable computer controlled motors such as servo motors and the like. Thus, the smart cart could be programmed to precisely align itself with a particular needle beam 216 and to effect the clamping of a needle board 126 thereto automatically under programmed computer control without operator intervention.

Existing needle looms 100, such as those illustrated in FIGS. 1–3 which are used in the woven and non-woven industries, incorporate tens of thousands of needles mounted to the reciprocating needle boards 126 to process the endless fabric web 128. A single needle loom 100 may contain between 1 and 14 needle boards 126 per needle zone 118, 120 and are installed in the needle beam modules 116. The needle beam modules 116 are installed across the width of the needle loom 100, a single needle loom may have as many as two upper needle board zones 118 and two lower needle board zones 120. The needles themselves require frequent replacement to account for needle wear, breakage and product demands. The present invention discloses an expeditious way for replacement and removal of the needle boards 126 from the needle loom 100 in an efficient and economical manner so as to minimize needle loom down time, as well as providing precise alignment of the needle boards within the needle beam modules 116.

Although the invention herein has been described with reference to particular embodiments, it is to be understood that the embodiments are merely illustrative of the principles and application of the present invention. For example, a needling apparatus such as a needle loom can be used to manufacture other nonwoven needled materials such as felts and the like. In addition, the present invention can also be used in other needling applications, such as in the capacity of a tacker as used in a tacking process. It is also contemplated that the needle boards 126 can be provided with wheels for moveable support within the stripper plate 266 thereby eliminating the use of the needle board carts 138. It is therefore to be understood that numerous modifications may be made to the embodiments and that other arrangements may be devised without departing from the spirit and scope of the present invention as defined by the claims.

What is claimed is:

1. A cart for supporting a needle board for installation and removal in a needling apparatus, said cart comprising a frame supportable for movement within said needling apparatus, a locator member attached to said frame, said locator member releasably engaging a portion of said needle board for aligning said needle board with said frame when supported thereon.

2. The cart of claim 1, wherein said locator member comprises a plate extending upwardly from said frame, said plate having an elongated opening terminating at an enlarged opening, said elongated opening receiving said portion of said needle board passing through said enlarged opening upon positioning said needle board on said frame.

3. The cart of claim 2, wherein said portion of said needle board comprises a pin extending outwardly therefrom.

4. The cart of claim 1, wherein said cart includes a plurality of wheels rotationally attached to said frame by a first and second plurality of axles, said first plurality of axles being arranged transverse to said second plurality of axles.

5. The cart of claim 1, further including a plurality of wheel assemblies for rotationally attaching a plurality of wheels to said frame, said wheel assemblies having an upper edge provided with a resilient or compressible member for supporting an edge of said needle board thereon.

6. The cart of claim 1, further including a locking member attached at one end of said frame, said locking member having a free end operative for releasably engaging a cooperating member attached to the frame of another cart when arranged adjacent thereto.

7. The cart of claim 6, wherein said free end of said locking member includes an opening for receiving said cooperating member on said adjacent cart, said opening dimensional to allowing longitudinal movement between adjacent carts.

8. The cart of claim 1, further including at least one rod attached at one end of said frame having a free end operative for abutting another cart when arranged adjacent thereto, said at least one rod having a predetermined length whereby adjacent carts are maintained in spaced relationship corresponding to said predetermined length.

9. The cart of claim 1, further including a needle board supported on said frame.

10. The cart of claim 9, wherein said portion of said needle board comprises a pin extending outwardly therefrom and said locator member comprises a plate having an opening for receiving said pin for alignment of said needle board with respect to said frame.

11. The cart of claim 1, wherein said locator member comprises a pair of upwardly extending spaced apart fingers attached to said frame forming an elongated opening therebetween, said fingers terminating at an enlarged opening formed between opposing sidewalls of said fingers at the terminal ends thereof, said enlarged opening being in communication with said elongated opening.

12. The cart of claim 1, wherein said locator member comprises a plate having sloping sidewalls extending upwardly from said frame, wherein said portion of said needle board comprises spaced apart pins for receiving said plate therebetween.

13. The cart of claim 1, wherein said locator member comprises an upwardly extending member from said frame, wherein said portion of said needle board comprises an extension having an opening for receiving said upwardly extending member therein.

14. The cart of claim 1, wherein said cart is slidably supportable within said needling apparatus.

15. The cart of claim 8, wherein said rod comprises a spring loaded member.

16. The cart of claim 8, wherein said another cart includes a rod for abutting said rod on said adjacent cart.

17. The cart of claim 16, wherein said rod on said another cart comprises a spring loaded member.

18. The cart of claim 1, wherein said locator member comprises a plate having sloping sidewalls extending upwardly from said frame, wherein said portion of said needle board comprises spaced apart pins for receiving said plate therebetween.

19. The cart of claim 18, wherein said locator member comprises an upwardly extending member from said frame, wherein said portion of said needle board comprises an extension having an opening for receiving said upwardly extending member therein.

20. The cart of claim 1, further including a lifting mechanism in operative association with said cart for lifting said cart when supported in said needling apparatus.

21. A cart supporting a needle board for installation in a needling apparatus, said cart comprising a frame having spaced apart sidewalls, a plurality of wheel assemblies attached to said sidewalls, each of said wheel assemblies having a first axle rotationally supporting a wheel and a second axle rotationally supporting another wheel, said first and second axles arranged transverse to each other, a plate extending upwardly from said frame, having an elongated opening communicating with an enlarged opening, and a needle board supported on said wheel assemblies, said needle board having at least one pin received within said elongated opening as said pin passes through said enlarged opening when positioning said needle board on said frame.

22. The cart of claim 21, wherein said first axle is positioned adjacent a bottom wall of said frame and said second axle is positioned adjacent said sidewall of said frame.

23. A needle beam for releasably securing a needle board thereto in a needling apparatus, said needle beam comprising a support plate for engaging a needle board, said needle board having a plurality of attachment members extending therefrom, said support plate having a plurality of openings for receiving said attachment members thereby aligning said needle board at a predetermined position to said needle beam, a clamp plate overlying said support plate moveable between a first position for engaging said attachment members extending through said support plate and a second position for releasing said attachment members, and an actuating device arranged between said clamp plate and said support plate, whereby actuation of said device draws said needle board against said support plate for securement thereto in alignment with said needle beam.

24. The needle beam of claim 23, wherein said actuating device comprises a resilient inflatable bladder.

25. The needle beam of claim 23, further including a needle board having said plurality of attachment members extending upwardly therefrom.

26. The needle beam of claim 25, wherein said clamp plate includes a plurality of openings for receiving a corresponding plurality of said attachment members.

27. The needle beam of claim 23, wherein at least one of said openings is in the shape of an elongated slot having a length dimension and a width dimension, wherein said width dimension is approximately the same as the dimension of said attachment member to be received therein to substantially preclude movement of said attachment member in the width direction and said length dimension being larger than the dimension of said attachment member to allow movement of said attachment member in the length direction.

28. The needle beam of claim 27, wherein at least another of said openings has a dimension approximately the same as the dimension of said attachment member to be received therein to substantially prevent movement of said attachment member in a radial direction.

29. The needle beam of claim 28, wherein said another opening includes a bushing defining said another opening.

30. The needle beam of claim 27, wherein at least another of said openings has a dimension larger than the dimension of said attachment member to be received therein to allow movement of said attachment member in a radial direction.

31. The needle beam of claim 25, wherein said attachment members each comprise an elongated cylindrical pin having a portion of reduced diameter, said clamp plate including a notch for engagement with said portion of reduced diameter when said clamp plate is in said first position.

32. The needle beam of claim 31, wherein said pin includes a terminal end having a diameter larger than the diameter of said portion of reduced diameter, whereby said pin is prevented from being withdrawn through said notch in said clamp plate when said notch is in engagement with said portion of reduced diameter.

33. The needle beam of claim 23, further including an actuating mechanism for controlling the movement of said clamp plate between said first and second positions.

34. The needle beam of claim 33, wherein said actuating mechanism comprises a device having a moveable rod coupled to said clamp plate.

35. The needle beam of claim 23 in combination with a cart for supporting said needle board for attachment of said needle board to said needle beam, said cart comprising a frame supported by a plurality of wheels operative for movement of said frame within said needling apparatus, a locator member attached to said frame, said locator member releasably engaging a portion of said needle board for aligning said needle board with said frame when supported thereby.

36. The combination needle beam and cart of claim 35, wherein said locator member comprises a plate extending upwardly from said frame, said plate having an elongated opening terminating at an enlarged opening, said elongated opening receiving said portion of said needle board passing through said enlarged opening upon positioning said needle board on said frame.

37. The combination needle beam and cart of claim 35, further including a locking member pivotally attached at one end of said frame, said locking member having a free end operative for releasably engaging a cooperating member attached to the frame of another cart when arranged adjacent thereto.

38. The combination needle beam and cart of claim 35, wherein said portion of said needle board comprises a pin extending outwardly therefrom and said locator member comprises a plate having an opening for receiving said pin for alignment of said needle board with respect to said frame.

39. The combination needle beam and cart of claims 35, further including a pin on said support plate for engaging said locator member.

40. The needle beam of claim 26, wherein said plurality of said attachment members and said plurality of openings are dimensioned and shaped to allow said needle board to be precision aligned with said needle beam independent of mechanical or manufacturing tolerances.

41. The needle beam of claim 27, wherein said elongated slot includes a bushing.

42. The needle beam of claim 34, wherein said device comprises a pneumatic device, a spring or a solenoid linear motor.

43. In a needling apparatus having a needle beam for releasable securing thereto a needle board, wherein the improvement comprises said needle board including a plurality of spaced apart attachment members extending upwardly therefrom, each of said attachment members having an engagement portion, and said needle beam comprising a support plate having a plurality of openings for respectively receiving one of said attachment members thereby aligning said needle board with said needle beam at a predetermined position, a clamp plate overlying said support plate moveable between a first position for engaging said engagement portions of said attachment members when extending through said openings in said support plate and a second position for disengaging from said engagement portions of said attachment members to allow withdrawal of said attachment members from said openings to allow removal of said needle board, and an inflatable bladder arranged between said clamp plate and said support plate of said needle beam opposing said needle board, whereby expansion of said bladder draws said needle board against said support plate for securement thereto in alignment with said needle beam.

44. In the needling apparatus of claim 43, wherein at least one of said openings is in the shape of an elongated slot having a length dimension and a width dimension, wherein said width dimension is approximately the same as the dimension of said attachment member to be received therein to substantially preclude movement of said attachment member in the width direction and said length dimension being larger than the dimension of said attachment member to allow movement of said attachment member in the length direction.

45. In the needling apparatus of claim 43, further including a reciprocal member coupled to said clamp plate, said reciprocal member operative for movement of said clamp plate between said first and second positions.

46. In the needling apparatus of claim 43, wherein said attachment member comprises an elongated cylindrical pin having a portion of reduced diameter forming said engagement portion, said clamp plate including a notch for engagement with said portion of reduced diameter when said clamp plate is in said first position.

47. In the needling apparatus of claim 46, wherein said pin includes a terminal end having a diameter larger than the diameter of said portion of reduced diameter, whereby said pin is prevented from being withdrawn through said notch in said clamp plate when said notch is in engagement with said portion of reduced diameter.

48. In the needling apparatus of claim 43, further including a cart for supporting said needle board for attachment of said needle board to said needle beam, said cart comprising a frame supported by a plurality of wheels operative for movement of said frame within said needling apparatus, a locator member attached to said frame, said locator member releasably engaging a portion of said needle board for aligning said needle board with said frame when supported thereby.

49. In the needling apparatus of claims 48, wherein said locator member comprises a plate extending upwardly from said frame, said plate having an elongated opening terminating at an enlarged opening, said enlarged opening receiving said portion of said needle board passing through said enlarged opening upon positioning said needle board on said frame.

50. In the needling apparatus of claim 49, further including a pin provided on said support plate, said pin being captured within said elongated opening for aligning said needle board with said needle beam.

51. In the needling apparatus of claim 48, further including a locking member pivotally attached at one end of said frame, said locking member having a free end operative for releasable engaging a cooperating member attached to the frame of another cart when arranged adjacent thereto.

52. In the needling apparatus of claim 48, wherein said portion of said needle board comprises a pin extending outwardly therefrom and said locator member comprises a plate having an opening for receiving said pin for alignment of said needle board with respect to said frame.

53. In the needling apparatus of claim 43, wherein said attachment member comprises an elongated pin terminating at an inverted cone-shaped body.

54. A system for attaching in a needle zone a plurality of needle boards to a plurality of needle beams in alignment therewith, said system comprising a plurality of needle boards each having a plurality of attachment members extending therefrom; a plurality of needle board carts each supporting one of said needle boards thereon, said needle board carts moveable within said needling apparatus to a position underlying one of said needle beams for attachment thereto of one of said needle boards supported by said cart, each of said carts including a locator member for alignment of said needle boards therewith when supported on said cart; and said needle beams each including a support plate having a plurality of openings for receiving therethrough said attachment members of a corresponding needle board thereby aligning said needle board at a predetermined position to said needle beam, a clamp plate overlying said support plate moveable between a first position for engaging said attachment members extending through said openings and a second position for releasing said attachment members, an actuating mechanism controlling the movement of said clamp plate between said first and second positions, and an actuating device between said clamp plate and a portion of said needle beam opposing said needle board, whereby actuation of said device draws said needle board against said support plate for attachment thereto in predetermined alignment therewith.

55. The system of claim 54, wherein said attachment members comprise an elongated cylindrical pin having an engageable portion, said clamp plate including a notch operative for engagement with said engageable portion when said clamp plate is in said first position.

56. The system of claim 55, wherein said pin includes a terminal end having a diameter larger than the diameter of said engageable portion, whereby said pin is prevented from being withdrawn through said notch in said clamp plate when said notch is in engagement with said engageable portion.

57. The system of claim 54, wherein said actuating mechanism comprises a member coupled to said clamp plate, said member operative for movement of said clamp plate between said first and second positions.

58. The system of claim 54, wherein said actuating device comprises a resilient inflatable bladder.

59. The system of claim 54, wherein at least one of said openings is in the shape of an elongated slot having a length dimension and a width dimension, wherein said width dimension is approximately the same as the dimension of said attachment member to be received therein to substantially preclude movement of said attachment member in the width direction and said length dimension being larger than the dimension of said attachment member to allow movement of said attachment member in the length direction.

60. The system of claim 59, wherein at least another of said openings has a dimension approximately the same as the dimension of said attachment member to be received therein to substantially prevent movement of said attachment member in a radial direction.

61. The system of claim 59, wherein said another opening includes a bushing defining said another opening.

62. The system of claim 59, wherein at least another of said openings has a dimension larger than the dimension of said attachment member to be received therein to allow movement of said attachment member in a radial direction.

63. The system of claim 54, wherein said locator member comprises a plate upwardly extending from said cart, said plate having an elongated opening terminating at an enlarged opening, said elongated opening receiving said portion of said needle board passing through said enlarged opening upon positioning said needle board on said cart.

64. The system of claim 63, further including a pin provided on said support plate, said pin being captured within said elongated opening for aligning said needle board with said needle beam.

65. The system of claim 63, wherein said portion of said needle board comprises a pin extending outwardly therefrom.

66. The system of claim 54, wherein said cart includes a resilient or compressible member for supporting said needle board when positioned on said cart.

67. The system of claim 66, wherein said cart includes a plurality of wheels rotationally supported by a plurality of first and second axles, said first axles arranged transverse to said second axles.

68. The system of claim 54, further including a latch on each of said carts for releasably connecting said carts in end to end relationship.

69. The system of claim 54, further including a biasing member for biasing said actuating mechanism for maintaining said clamp plate in said first position.

70. A method for replacing a plurality of needle boards in a needle zone including a plurality of needle beams each having a support plate provided with a plurality of openings and a clamp plate assembly associated therewith, said method comprising providing a plurality of needle boards having a plurality of attachment members extending therefrom, supporting said needle boards on a corresponding needle board cart, advancing a plurality of said needle board carts with said needle boards supported thereon in end to end relationship into said needle zone underlying said needle beams, passing said attachment members through said openings in said support plate of said needle beam, activating said clamp plate assembly to engage said attachment members extending through said support plate on an underlying needle board, and securing said needle boards to said needle beams.

71. The method of claim 70, further including releasable attaching said needle board carts in end to end relationship while inserting said carts into said needle zone.

72. The method of claim 70, wherein said supporting step further includes aligning said needle boards with said needle board carts by capturing a portion of said needle board with a locator member attached to said needle board carts.

73. The method of claim 72, wherein said portion of said needle board carts comprise at least one locator pin and said locator member comprises a plate upwardly extending from said cart, said plate having a portion receiving said at least one locator pin upon positioning said needle board on said cart.

74. The method of claim 70, wherein said advancing step includes maintaining said carts in predetermined spaced apart end to end relationship.

75. The method of claim 74, wherein said carts are maintained in said spaced apart end to end relationship by a rod extending outwardly from one end of said cart abutting an adjacent cart.

76. The method of claim 70, wherein said assembly includes a plurality of notches for engaging a corresponding one of said attachment members upon activating said assembly.

77. The method of claim 70, wherein at least one of said openings is in the shape of an elongated slot having a length dimension and a width dimension, wherein said width dimension is approximately the same as the dimension of said attachment member to be received therein to substantially preclude movement of said attachment member in the width direction and said length dimension being larger than the dimension of said attachment member to allow movement of said attachment member in the length direction.

78. The method of claim 77, wherein at least another of said openings has a dimension approximately the same as the dimension of said attachment member to be received therein to substantially prevent movement of said attachment member in a radial direction.

79. The method of claim 70, further including providing a pin extending from said support plate and capturing said pin within a portion of said needle board cart.

80. The method of claim 79, wherein said portion of said needle board cart comprises a pair of spaced apart fingers providing an opening therebetween.

81. The method of claim 70, wherein said securing step comprises linearly separating said clamp plate assembly with respect to said support plate.

82. The method of claim 70, further including aligning said needle boards with said needle beams, said aligning comprising providing a first member on said needle board and a second member on said needle beam, and mating said first and second members together.

83. The method of claim 70, wherein said needle board carts are advanced along a stripper plate within said needle zone, and moving said stripper plate for bringing said needle board into facing contact with said needle beam.

84. The method of claim 83, further including moving said needle beam for bringing said needle beam into facing contact with said needle board.

85. The method of claim 70, further including moving said needle beam for bringing said needle beam into facing contact with said needle board.

86. A method for replacing a needle board in a needle zone including a needle beam having a support plate provided with a plurality of openings, said method comprising providing a needle board having a plurality of attachment members and a pin extending therefrom, providing a needle board cart having an opening, supporting said needle board on said cart with said pin received within said opening, positioning said needle board supported by said cart underlying said needle beam, passing said attachment members through said openings in said support plate of said needle beam, engaging said attachment members extending through said support plate for supporting said needle board by said needle beam independent of said cart, and securing said needle board to said needle beam.

87. The method of claim 86, wherein said support plate includes a pin, said method further including receiving said pin on said support plate within said opening when said attachment members pass through said openings in said support plate.

88. The method of claim 87, wherein said attachment members have a portion of reduced diameter to be engaged by a clamp plate assembly during said engaging step.

89. The method of claim 87, wherein said securing step comprises inflating an inflatable bladder for drawing said needle board against said needle beam.

90. The method of claim 87, wherein said opening on said needle board cart is an elongated opening provided within a plate extending upwardly from said cart.

91. The method of claim 86, further including storing a plurality of said needle board carts in an apparatus operative for inserting and withdrawing said carts therefrom.

92. The method of claim 91, further including providing a needle board on said plurality of said needle board carts within said apparatus for removal therefrom.

93. The method of claim 86, further including aligning said needle boards with said needle beams, said aligning comprising providing a first member on said needle board and a second member on said needle beam, and mating said first and second members together.

94. The method of claim 86, wherein said needle board carts are advanced along a stripper plate within said needle zone, and moving said stripper plate for bringing said needle board into facing contact with said needle beam.

95. The method of claim 94, further including moving said needle beam for bringing said needle beam into facing contact with said needle board.

96. The method of claim 86, further including moving said needle beam for bringing said needle beam into facing contact with said needle board.

97. A method for replacing a plurality of needle boards in a needle zone including a plurality of needle beams each having a support plate and a clamp plate assembly associated therewith having a plurality of attachment members extending therefrom, said method comprising providing a plurality of needle boards having a plurality of openings, supporting said needle boards on a corresponding needle board cart, advancing a plurality of said needle board carts with said needle boards supported thereon in end to end relationship into said needle zone underlying said needle beams, passing said attachment members through said openings in said needle boards, activating said clamp plate assembly to engage said attachment members extending through said openings on an underlying needle board, and securing said needle boards to said needle beams.

98. The method of claim 97, wherein said supporting step further includes aligning said needle boards with said needle board carts by capturing a portion of said needle board with a locator member attached to said needle board carts.

99. The method of claim 98, wherein said portion of said needle board carts comprise at least one locator pin and said locator member comprises a plate upwardly extending from said cart, said plate having a portion receiving said at least one locator pin upon positioning said needle board on said cart.

100. The method of claim 97, further including providing a pin extending from said support plate and capturing said pin within a portion of said needle board cart.

101. The method of claim 100, wherein said portion of said needle board cart comprises a locator member.

102. The method of claim 97, further including aligning said needle boards with said needle beams, said aligning comprising providing a first member on said needle board and a second member on said needle beam, and mating said first and second members together.

103. The method of claim 97, wherein said needle board carts are advanced along a stripper plate within said needle zone, and moving said stripper plate for bringing said needle board into facing contact with said needle beam.

104. The method of claim 103, further including moving said needle beam for bringing said needle beam into facing contact with said needle board.

105. The method of claim 97, further including moving said needle beam for bringing said needle beam into facing contact with said needle board.

106. A needle beam for releasably securing a needle board thereto in a needling apparatus, said needle beam comprising a support plate for engaging a needle board, a clamp plate overlying said support plate having a plurality of attachment members extending therefrom, said needle board having a plurality of openings for receiving said attachment members thereby aligning said needle board at a predetermined position to said needle beam, said clamp plate moveable between a first position for engaging said attachment members extending through said needle board and a second position for releasing said attachment members, and an actuating device arranged between said clamp plate and said support plate, whereby actuation of said device draws said needle board against said support plate for securement thereto in alignment with said needle beam.

107. The needle beam of claim 106 in combination with a cart for supporting said needle board for attachment of said needle board to said needle beam, said cart comprising a frame supported by a plurality of wheels operative for movement of said frame within said needling apparatus, a locator member attached to said frame, said locator member releasably engaging a portion of said needle board for aligning said needle board with said frame when supported thereby.

108. The combination needle beam and cart of claim 107, further including a lifting mechanism in operative association with said cart for lifting said cart when supported in said needling apparatus.

109. The combination needle beam and cart of claim 107, wherein said locator member comprises a plate having sloping sidewalls extending upwardly from said frame, wherein said portion of said needle board comprises spaced apart pins for receiving said plate therebetween.

110. The combination needle beam and cart of claim 107, wherein said locator member comprises an upwardly extending member from said frame, wherein said portion of said needle board comprises an extension having an opening for receiving said upwardly extending member therein.

111. The combination needle beam and cart of claim 107, wherein said locator member comprises a plate extending upwardly from said frame, said plate having an elongated opening terminating at an enlarged opening, said elongated opening receiving said portion of said needle board passing through said enlarged opening upon positioning said needle board on said frame.

* * * * *

UNITED STATES PATENT AND TRADEMARK OFFICE

CERTIFICATE OF CORRECTION

PATENT NO. : 6,145,176

DATED : November 14, 2000

INVENTOR(S) : Egnaczak et al.

It is certified that error appears in the above-identified patent and that said Letters Patent is hereby corrected as shown below:

ON THE TITLE PAGE

In the Abstract, line 7, "underling" should read -- underlying --.

Column 4, line 12, "expedites" should read -- expedite --.
Column 11, line 15 "to extend" should read -- extends --.
Column 11, line 44, after "as" insert -- to --.
Column 14, line 59, after "acts" insert -- as --.
Column 16, line 1, "are" should read -- is --.
Column 18, line 14, "provide" should read -- provides --.
Column 24, line 29, "claims" should read -- claim --.
Column 24, line 43, "releasable" should read -- releasably --.
Column 26, line 22, "releasable" should read -- releasably --.
Column 26, line 30, "comprise" should read -- comprises --.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*